US010814654B2

(12) United States Patent
Takeuchi

(10) Patent No.: US 10,814,654 B2
(45) Date of Patent: Oct. 27, 2020

(54) LIQUID JETTING APPARATUS AND METHOD OF COPING WITH FLOATING OF MEDIUM

(71) Applicant: FUJIFILM Corporation, Tokyo (JP)

(72) Inventor: Makoto Takeuchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/445,223

(22) Filed: Jun. 19, 2019

(65) Prior Publication Data

US 2019/0299684 A1 Oct. 3, 2019

Related U.S. Application Data

(63) Continuation of application No. PCT/JP2018/006500, filed on Feb. 22, 2018.

(30) Foreign Application Priority Data

Feb. 27, 2017 (JP) ..... 2017-035053

(51) Int. Cl.
*B41J 25/304* (2006.01)
*B41J 2/045* (2006.01)
(Continued)

(52) U.S. Cl.
CPC ..... *B41J 25/304* (2013.01); *B41J 2/04556* (2013.01); *B41J 3/543* (2013.01);
(Continued)

(58) Field of Classification Search
CPC ... B41J 25/304; B41J 2/04556; B41J 25/3082
See application file for complete search history.

(56) References Cited

U.S. PATENT DOCUMENTS 9,815,307 B2 * 11/2017 Mueller ..... B41J 11/0095
2004/0233244 A1 11/2004 Elgee et al.
(Continued)

FOREIGN PATENT DOCUMENTS

JP 2007076109 3/2007
JP 2007145504 6/2007
(Continued)

OTHER PUBLICATIONS

"International Search Report (Form PCT/ISA/210) of PCT/JP2018/006500," dated Mar. 27, 2018, with English translation thereof, pp. 1-5.
(Continued)

*Primary Examiner* — Julian D Huffman
(74) *Attorney, Agent, or Firm* — JCIPRNET

(57) ABSTRACT

There are provided a liquid jetting apparatus and a method of coping with the floating of a medium that enable the originally required moving distance of a liquid jet head to be set in a case where the contact between the liquid jet head and a medium caused by the floating of the medium is to be avoided. The liquid jetting apparatus includes a first medium floating detection unit (140) that detects the floating of a medium, a first head raising/lowering unit (400) that moves a first liquid jet head, a first movement parameter setting unit (142) that sets a first movement parameter, a first head raising/lowering control unit (120) that controls the first head raising/lowering unit, a second head raising/lowering unit (400) that moves a second liquid jet head, a second movement parameter setting unit (142) that sets a second movement parameter separately from the first movement parameter, and a second head raising/lowering control unit (120) that controls the second head raising/lowering unit.

11 Claims, 17 Drawing Sheets

(51) Int. Cl.

| | |
|---|---|
| ***B41J 3/54*** | (2006.01) |
| ***B41J 25/00*** | (2006.01) |
| ***B41J 13/22*** | (2006.01) |
| ***B41J 25/308*** | (2006.01) |

(52) U.S. Cl.
CPC ..... *B41J 13/223* (2013.01); *B41J 25/3082* (2013.01); *B41J 2025/008* (2013.01); *B41J 2202/21* (2013.01)

(56) References Cited

U.S. PATENT DOCUMENTS

| | | | |
|---|---|---|---|
| 2013/0135370 | A1 | 5/2013 | Oba et al. |
| 2014/0347414 | A1 | 11/2014 | Oba et al. |

FOREIGN PATENT DOCUMENTS

| | | |
|---|---|---|
| JP | 2012143944 | 8/2012 |
| JP | 2013107350 | 6/2013 |
| JP | 2016124235 | 7/2016 |

OTHER PUBLICATIONS

"Written Opinion of the International Searching Authority (Form PCT/ISA/237) of PCT/JP2018/006500," dated Mar. 27, 2018, with English translation thereof, pp. 1-18.
"Office Action of Japan Counterpart Application", dated Mar. 19, 2020, with English translation thereof, pp. 1-17.
Office Action of Japan Counterpart Application, with English translation thereof, dated May 26, 2020, pp. 1-6.

* cited by examiner

LIQUID JETTING APPARATUS AND METHOD OF COPING WITH FLOATING OF MEDIUM

CROSS-REFERENCE TO RELATED APPLICATIONS

The present application is a Continuation of PCT International Application No. PCT/JP2018/006500 filed on Feb. 22, 2018 claiming priority under 35 U.S.C § 119(a) to Japanese Patent Application No. 2017-035053 filed on Feb. 27, 2017. Each of the above applications is hereby expressly incorporated by reference, in their entirety, into the present application.

BACKGROUND OF THE INVENTION

1. Field of the Invention

The present invention relates to a liquid jetting apparatus and a method of coping with the floating of a medium, and more particularly, to a technique for coping with a case where floating occurs on a medium.

2. Description of the Related Art

In a liquid jetting apparatus that jets liquid onto a medium by liquid jet heads, the contact between the liquid jet heads and the medium may be caused by the occurrence of the floating of a medium. In a case where the contact between the liquid jet heads and the medium occurs, there is a concern that damage to the liquid jet heads, the abnormal transport of a medium, and the like may occur.

JP2016-124235A discloses a liquid jetting apparatus that moves a liquid jet head to increase a distance between a liquid jet surface and a medium in a case where the liquid jet surface of the liquid jet head and the medium are close to each other. The liquid jetting apparatus disclosed in JP2016-124235A comprises a sensor that measures a distance between the liquid jet surface and a medium, and changes the height of the liquid jet head according to a distance between the liquid jet surface and the medium.

A liquid jet surface of this specification corresponds to an ink jet surface disclosed in JP2016-124235A. A medium of this specification corresponds to a recording medium disclosed in JP2016-124235A. A liquid jetting apparatus of this specification corresponds to a recording apparatus disclosed in JP2016-124235A.

SUMMARY OF THE INVENTION

A plurality of liquid jet heads are mounted on a head unit in the liquid jetting apparatus disclosed in JP2016-124235A. In a case where the height of the liquid jet head is to be changed, the heights of the plurality of liquid jet heads are changed into the same height.

In this case, there may be a liquid jet head of which an actually set moving distance is longer than an originally required moving distance in a case where the plurality of liquid jet heads are moved to avoid the contact between the liquid jet heads and a medium. As a result, there is a concern that a mechanism for moving the liquid jet heads, a drive source for the mechanism for moving the liquid jet heads, and the like may increase in size.

The invention has been made in consideration of the above-mentioned circumstances, and an object of the invention is to provide a liquid jetting apparatus and a method of coping with the floating of a medium that enable the originally required moving distance of a liquid jet head to be set in a case where the contact between the liquid jet head and a medium caused by the floating of the medium is to be avoided.

The following aspects of the invention are provided to achieve the above-mentioned object.

A liquid jetting apparatus according to a first aspect comprises a medium transport unit that includes a medium support surface supporting a sheet-like medium and transports the medium along a medium transport direction, a first medium floating detection unit that detects floating of the medium transported by the medium transport unit, a first liquid jet head that is disposed at a position on a downstream side of the first medium floating detection unit in the medium transport direction and jets liquid onto the medium transported by the medium transport unit, a second liquid jet head that is disposed at a position on a downstream side of the first liquid jet head in the medium transport direction and jets liquid onto the medium transported by the medium transport unit, a first head raising/lowering unit that moves the first liquid jet head in a direction having a component corresponding to a direction opposite to a direction of gravity or in a direction having a component corresponding to the direction of gravity, a first movement parameter setting unit that sets a first movement parameter including a moving distance of the first liquid jet head moved by the first head raising/lowering unit, a first head raising/lowering control unit that controls an operation of the first head raising/lowering unit using the first movement parameter set by the first movement parameter setting unit, a second head raising/lowering unit that moves the second liquid jet head in the direction having the component corresponding to the direction opposite to the direction of gravity or in the direction having the component corresponding to the direction of gravity, a second movement parameter setting unit that sets a second movement parameter including a moving distance of the second liquid jet head moved by the second head raising/lowering unit separately from the first movement parameter including the moving distance of the first liquid jet head set by the first movement parameter setting unit, and a second head raising/lowering control unit that controls an operation of the second head raising/lowering unit using the second movement parameter set by the second movement parameter setting unit.

According to the first aspect, the moving distance of the first liquid jet head and the moving distance of the second liquid jet head are individually set in a case where the contact between the medium and the liquid jet heads caused by the floating of the medium is to be avoided. Accordingly, in a case where each liquid jet head is to be moved to avoid the contact between the liquid jet heads and the medium caused by the floating of the medium, a moving distance originally required for each liquid jet head can be set for each liquid jet head.

The respective liquid jet heads can be moved on the basis of the moving distances that are individually set for the liquid jet heads. Accordingly, the contact between each liquid jet head and a medium can be avoided even in a case where the floating distances of the medium at the positions of the respective liquid jet heads are different from each other.

According to a second aspect, in the liquid jetting apparatus of the first aspect, the first head raising/lowering control unit may use the first head raising/lowering unit to raise and lower the first liquid jet head between a first jet position where liquid is jetted from the first liquid jet head and a first retreat position, which is away from the first jet position in a moving direction of the first liquid jet head by the moving distance of the first liquid jet head, on the basis of the first movement parameter set by the first movement parameter setting unit in a case where the floating of the medium is detected by the first medium floating detection unit; and the second head raising/lowering control unit may use the second head raising/lowering unit to raise and lower the second liquid jet head between a second jet position where liquid is jetted from the second liquid jet head and a second retreat position, which is away from the second jet position in a moving direction of the second liquid jet head by the moving distance of the second liquid jet head, on the basis of the second movement parameter set by the second movement parameter setting unit in a case where the floating of the medium is detected by the first medium floating detection unit.

According to the second aspect, the first liquid jet head can be raised and lowered between the first jet position and the first retreat position on the basis of the first movement parameter. Further, the second liquid jet head can be raised and lowered between the second jet position and the second retreat position on the basis of the second movement parameter.

A predetermined distance may be added to the floating distance of the medium at the jet position of the first liquid jet head to calculate a distance between the first jet position and the first retreat position. Further, a predetermined distance may be added to the floating distance of the medium at the jet position of the second liquid jet head to calculate a distance between the second jet position and the second retreat position.

The kind of the medium, the floating distance of the medium, the transport speed of the medium, and the like can be used as parameters to determine the predetermined distances.

According to a third aspect, in the liquid jetting apparatus of the first or second aspect, the first movement parameter setting unit may set the first movement parameter including a moving speed of the first liquid jet head moved by the first head raising/lowering unit, and the second movement parameter setting unit may set the second movement parameter including a moving speed of the second liquid jet head moved by the second head raising/lowering unit.

According to the third aspect, the moving speed of the first liquid jet head and the moving speed of the second liquid jet head can be individually set.

The first movement parameter setting unit may set the moving speed of the first liquid jet head corresponding to the floating distance of the medium. The second movement parameter setting unit may set the moving speed of the second liquid jet head corresponding to the floating distance of the medium.

According to a fourth aspect, in the liquid jetting apparatus of any one of the first to third aspects, the first medium floating detection unit may detect a floating distance of the medium at a position of the first medium floating detection unit on a transport path of the medium, and the first movement parameter setting unit may set a distance between a position of the first liquid jet head and the position of the first medium floating detection unit on the transport path of the medium to be transported by the medium transport unit, a transport speed of the medium transported by the medium transport unit, and a moving distance of the first liquid jet head, which is calculated using the floating distance of the medium detected by the first medium floating detection unit, as the first movement parameter.

According to the fourth aspect, the distance between the first medium floating detection unit and the first liquid jet head on the transport path of the medium, the transport speed of the medium, and the moving distance of the first liquid jet head, which is calculated on the basis of the floating distance of the medium, can be set as the first movement parameter.

According to a fifth aspect, in the liquid jetting apparatus of the fourth aspect, the second movement parameter setting unit may set a distance between a position of the second liquid jet head and the position of the first medium floating detection unit on the transport path of the medium to be transported by the medium transport unit, a transport speed of the medium transported by the medium transport unit, and a moving distance of the second liquid jet head, which is calculated using the floating distance of the medium detected by the first medium floating detection unit, as the second movement parameter.

According to the fifth aspect, the distance between the first medium floating detection unit and the second liquid jet head on the transport path of the medium, the transport speed of the medium, and the moving distance of the second liquid jet head, which is calculated on the basis of the floating distance of the medium, can be set as the second movement parameter.

According to a sixth aspect, in the liquid jetting apparatus of any one of the first to fifth aspects, the medium transport unit may comprise a transport drum that has a cylindrical shape and is rotated about a central axis of the cylindrical shape as a rotating axis to transport the medium along an outer peripheral surface thereof, and the second movement parameter setting unit may set the moving distance of the second liquid jet head that exceeds the moving distance of the first liquid jet head.

According to the sixth aspect, in a case where the medium transport unit comprises the transport drum, the moving distance of the second liquid jet head, which is disposed at a position on the downstream side in the medium transport direction, is a moving distance exceeding the moving distance of the first liquid jet head that is disposed at a position on the upstream side in the medium transport direction. Accordingly, in a case where the floating distance of the medium at the position on the downstream side is longer than the floating distance of the medium at the position on the upstream side in the medium transport direction, the contact between the first liquid jet head and the medium can be avoided and the contact between the second liquid jet head and the medium can be avoided.

According to a seventh aspect, the liquid jetting apparatus of the sixth aspect may further comprise a third liquid jet head that is disposed at a position on a downstream side of the second liquid jet head in the medium transport direction and jets liquid onto the medium transported by the medium transport unit, a third head raising/lowering unit that moves the third liquid jet head in the direction having the component corresponding to the direction opposite to the direction of gravity or in the direction having the component corresponding to the direction of gravity, a third movement parameter setting unit that sets a third movement parameter including a moving distance of the third liquid jet head moved by the third head raising/lowering unit separately from the first movement parameter including the moving distance of the first liquid jet head set by the first movement parameter setting unit and the second movement parameter including the moving distance of the second liquid jet head set by the second movement parameter setting unit, and a third head raising/lowering control unit that controls an operation of the third head raising/lowering unit using the third movement parameter set by the third movement parameter setting unit; and the third movement parameter setting unit may set the moving distance of the third liquid jet head that exceeds the moving distance of the second liquid jet head.

According to the seventh aspect, the liquid jetting apparatus comprises three liquid jet heads, and the contact between the first liquid jet head and the medium can be avoided, the contact between the second liquid jet head and the medium can be avoided, and the contact between the third liquid jet head and the medium can be avoided in a case where the floating of the medium, which allows the floating distance of the medium at a position on the downstream side to be longer than the floating distance of the medium at a position on the upstream side in the medium transport direction occurs.

An aspect in which the liquid jetting apparatus comprises four or more liquid jet heads can also be made. In an aspect in which the liquid jetting apparatus further comprises a fourth liquid jet head at a position on the downstream side of the third liquid jet head in the medium transport direction, the liquid jetting apparatus can further comprise a fourth liquid jet head raising/lowering unit, a fourth movement parameter setting unit, and a fourth head raising/lowering control unit.

According to an eighth aspect, in the liquid jetting apparatus of the sixth or seventh aspect, the transport drum may comprise a grip part that includes a plurality of grip members gripping a front end region of the medium.

According to the eighth aspect, the floating of the rear end region of the medium is likely to occur, and the contact between the medium and the liquid jet head can be avoided in an aspect in which the liquid jetting apparatus further comprises the grip part gripping the front end region of the medium.

The front end region of the medium is a region that has a predetermined length from the front end of the medium in the medium transport direction. The front end of the medium is the downstream end of the medium in the medium transport direction. The rear end region of the medium is a region that has a predetermined length from the rear end of the medium in the medium transport direction. The rear end of the medium is the upstream end of the medium in the medium transport direction.

According to a ninth aspect, the liquid jetting apparatus of any one of the first to fourth aspects may further comprise a second medium floating detection unit that is disposed at a position on a downstream side of the first liquid jet head in the medium transport direction and on an upstream side of the second liquid jet head in the medium transport direction and detects the floating of the medium transported by the medium transport unit and a floating distance of the medium transported by the medium transport unit; and the second movement parameter setting unit may set a distance between a position of the second liquid jet head and the position of the second medium floating detection unit on the transport path of the medium to be transported by the medium transport unit, a transport speed of the medium transported by the medium transport unit, and a moving distance of the second liquid jet head, which is calculated using the floating distance of the medium detected by the second medium floating detection unit, as the second movement parameter.

According to the ninth aspect, the liquid jetting apparatus further comprises the second medium floating detection unit that is disposed at a position on the upstream side of the second liquid jet head and on the downstream side of the first liquid jet head in the medium transport direction and detects the floating of the medium and the floating distance of the medium. Accordingly, it is possible to set the moving distance of the second liquid jet head in a case where the contact between the second liquid jet head and the medium is to be avoided.

According to a tenth aspect, in the liquid jetting apparatus of the ninth aspect, the medium transport unit may comprise a planar medium transport member that transports the medium on a plane parallel to the medium support surface.

According to the tenth aspect, the moving distances of the respective liquid jet heads, which are to be moved to avoid the contact between the respective liquid jet heads and the medium, can be individually set in an aspect in which a medium is transported by the planar medium transport member.

A method of coping with the floating of a medium according to an eleventh aspect is a method of coping with floating of a medium for a liquid jetting apparatus that includes a first liquid jet head jetting liquid onto a sheet-like medium transported along a medium transport direction and a second liquid jet head disposed at a position on a downstream side of the first liquid jet head in the medium transport direction. The method comprises: a medium floating detection step of detecting floating of the sheet-like medium that is supported by a medium support surface and transported along the medium transport direction; a first movement parameter-setting step of setting a first movement parameter, which includes a moving distance of the first liquid jet head in a direction having a component corresponding to a direction opposite to a direction of gravity, in a case where the floating of the medium is detected in the medium floating detection step; a second movement parameter-setting step of setting a second movement parameter that includes a moving distance of the second liquid jet head in the direction having the component corresponding to the direction opposite to the direction of gravity separately from the first movement parameter including the moving distance of the first liquid jet head in a case where the floating of the medium is detected in the medium floating detection step; a first head moving step of moving the first liquid jet head from a first jet position where liquid is jetted from the first liquid jet head to a first retreat position, which is away from the first jet position in a moving direction of the first liquid jet head by the moving distance of the first liquid jet head, on the basis of the first movement parameter set in the first movement parameter-setting step in a case where the floating of the medium is detected in the medium floating detection step; and a second head moving step of moving the second liquid jet head from a second jet position where liquid is jetted from the second liquid jet head to a second retreat position, which is away from the second jet position in a moving direction of the second liquid jet head by the moving distance of the second liquid jet head, on the basis of the second movement parameter set in the second movement parameter-setting step in a case where the floating of the medium is detected in the medium floating detection step.

According to the eleventh aspect, the same effects as the first aspect can be obtained.

In the eleventh aspect, the same items as the items specified in the second to tenth aspects can be properly combined. In this case, components, which take charge of processing or functions specified in the liquid jetting apparatus, can be grasped as components, which take charge of processing or functions corresponding to the processing or functions, of the method of coping with the floating of a medium.

According to the invention, the moving distance of the first liquid jet head and the moving distance of the second liquid jet head are individually set in a case where the contact between the medium and the liquid jet heads caused by the floating of the medium is to be avoided. Accordingly, in a case where each liquid jet head is to be moved to avoid the contact between the liquid jet heads and the medium caused by the floating of the medium, a moving distance originally required for each liquid jet head can be set for each liquid jet head.

The respective liquid jet heads can be moved on the basis of the moving distances that are individually set for the liquid jet heads. Accordingly, the contact between each liquid jet head and a medium can be avoided even in a case where the floating distances of the medium at the positions of the respective liquid jet heads are different from each other.

DESCRIPTION OF THE PREFERRED EMBODIMENTS

Figure 1:
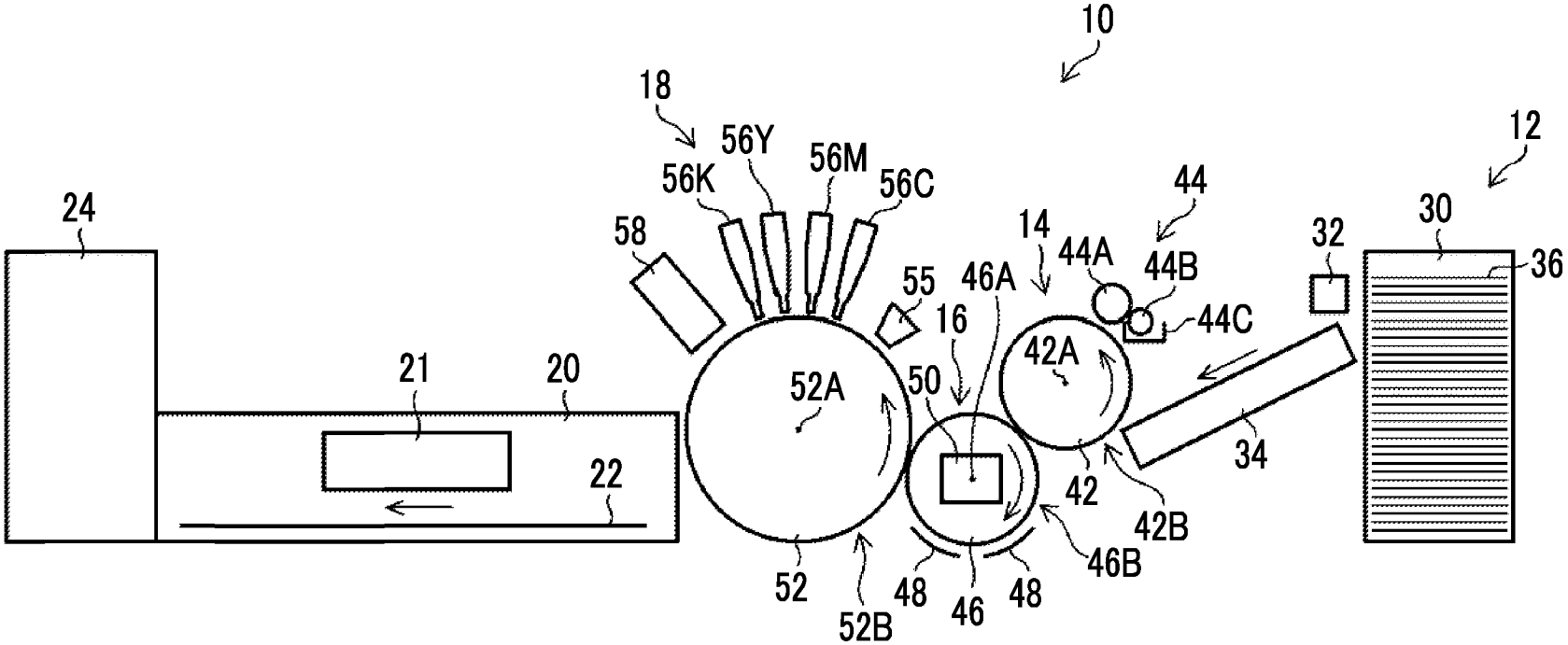
FIG. 1 is a diagram showing the schematic configuration of the entire ink jet recording apparatus.

Preferred embodiments of the invention will be described in detail below with reference to the accompanying drawings. In this specification, the same components will be denoted by the same reference numerals and the repeated description thereof will be omitted.

Description of Terms

The term of "parallel" in this specification includes "substantially parallel" where two directions cross each other but the same effects as the effects, which are obtained in a case where the two directions are parallel to each other, can be obtained.

The term of "orthogonal" includes "substantially orthogonal" where two directions cross each other at an angle smaller than 90° or an angle exceeding 90° but the same effects as the effects, which are obtained in a case where the two directions are orthogonal to each other, can be obtained.

The term of "the same" includes "substantially the same" where there are differences between components but the same effects as the effects, which are obtained in a case where the components are the same, are obtained.

[Description of Ink Jet Recording Apparatus]

<Overall Configuration>

FIG. 1 is a diagram showing the schematic configuration of the entire ink jet recording apparatus. The ink jet recording apparatus 10 shown in FIG. 1 is an image forming apparatus that applies an ink jet system to perform drawing on a medium.

The sheet-like medium is a material on which an ink jet system can be applied to perform drawing or to form a pattern, such as sheet-like paper, a sheet-like fiber, a sheet-like metal material, or a sheet-like resin material. Hereinafter, the medium can be substituted with a sheet. A sheet 36 shown in FIG. 1 is one aspect of a medium. Further, image forming can be substituted with drawing.

The ink jet recording apparatus 10 shown in FIG. 1 comprises a sheet feed unit 12, a treatment liquid-application section 14, a treatment liquid-drying processing section 16, a drawing unit 18, an ink-drying processing section 20, and a sheet discharge unit 24. The ink jet recording apparatus 10 may comprise a head maintenance section (not shown).

The sheet feed unit 12, the treatment liquid-application section 14, the treatment liquid-drying processing section 16, the drawing unit 18, the ink-drying processing section 20, and the sheet discharge unit 24 are arranged along a sheet transport direction, which is the transport direction of the sheet 36, in the order of the sheet feed unit 12, the treatment liquid-application section 14, the treatment liquid-drying processing section 16, the drawing unit 18, the ink-drying processing section 20, and the sheet discharge unit 24.

Next, the structure of each part of the ink jet recording apparatus 10 will be described in detail. The ink jet recording apparatus 10 described in this embodiment is one aspect of a liquid jetting apparatus. Ink is one aspect of liquid. The sheet transport direction corresponds to a medium transport direction.

<Sheet Feed Unit>

The sheet feed unit 12 shown in FIG. 1 comprises a stocker 30, a sheet feed sensor 32, and a feeder board 34.

Sheets 36 are stored in the stocker 30. The sheet feed sensor 32 detects the sheet 36 taken out from the stocker 30.

An optical sensor can be applied as the sheet feed sensor 32, and examples of the optical sensor include a light projection type passage sensor that comprises a light projecting part and a light receiving part. Information on a sheet 36, which is acquired using the sheet feed sensor 32, is sent to a sheet feed control unit 110 through a system controller 100 shown in FIG. 8. The sheet feed sensor 32 is not shown in FIG. 8.

Further, in a case where a plurality of sheets 36 are successively fed, information on a sheet 36, which is acquired using the sheet feed sensor 32, can be applied to the detection of the feed timing of each sheet 36.

The feeder board 34 corrects the posture of a sheet 36 that is taken out from the stocker 30. The sheet 36 of which the posture is corrected by the feeder board 34 is delivered to the treatment liquid-application section 14. An arrow line, which is shown above the feeder board 34, indicates the sheet transport direction on the feeder board 34.

<Treatment Liquid-Application Section>

The treatment liquid-application section 14 shown in FIG. 1 comprises a treatment liquid drum 42 and a treatment liquid-application device 44. The treatment liquid drum 42 has a cylindrical shape. The treatment liquid drum 42 is supported so as to be rotatable about a central axis of the cylindrical shape as a rotating shaft 42A.

The entire length of the treatment liquid drum 42 in an axial direction corresponds to the maximum width of a sheet 36 having the maximum size. The width of a sheet 36 is the length of the sheet 36 in a direction orthogonal to the sheet transport direction. The axial direction of the treatment liquid drum 42 is a direction parallel to the rotating shaft of the treatment liquid drum 42. The axial direction of the treatment liquid drum 42 in FIG. 1 is a direction perpendicular to the plane of FIG. 1.

The axial direction of a treatment liquid-drying processing drum 46 and the axial direction of a drawing drum 52 to be described later are also the same as the axial direction of the treatment liquid drum 42.

The treatment liquid drum 42 comprises a gripper (not shown). The gripper comprises a plurality of claws. The plurality of claws are arranged along the axial direction of the treatment liquid drum 42. The plurality of claws grip the front end portion of a sheet 36. The sheet 36 of which the front end portion is gripped by the gripper is supported on an outer peripheral surface 42B of the treatment liquid drum 42. The sheet 36, which is supported on the outer peripheral surface 42B of the treatment liquid drum 42, is not shown.

Since the treatment liquid drum 42 grips the front end portion of the sheet 36 by the gripper and is rotated while supporting the sheet 36 on the outer peripheral surface 42B, the treatment liquid drum 42 transports the sheet 36 along the outer peripheral surface 42B. An arrow line, which is shown in the treatment liquid drum 42, indicates the sheet transport direction in the treatment liquid-application section 14.

The treatment liquid-application device 44 comprises an application roller 44A, a measurement roller 44B, and a treatment liquid container 44C. Treatment liquid has a function to aggregate or insolubilize ink. The sheet 36 to which the treatment liquid is applied by the treatment liquid-application section 14, is delivered to the treatment liquid-drying processing section 16.

<Treatment Liquid-Drying Processing Section>

The treatment liquid-drying processing section 16 shown in FIG. 1 comprises a treatment liquid-drying processing drum 46, transport guides 48, and a treatment liquid-drying processing device 50. The treatment liquid-drying processing drum 46 has a cylindrical shape. The treatment liquid-drying processing drum 46 is supported so as to be rotatable about a central axis of the cylindrical shape as a rotating shaft 46A.

The treatment liquid-drying processing drum 46 comprises a gripper that has the same structure as the gripper of the treatment liquid drum 42. The gripper of the treatment liquid-drying processing drum 46 grips the front end portion of the sheet 36. The gripper of the treatment liquid-drying processing drum 46 is not shown.

Since the treatment liquid-drying processing drum 46 grips the front end portion of the sheet 36 by the gripper and is rotated while supporting the sheet 36 on an outer peripheral surface 46B, the treatment liquid-drying processing drum 46 transports the sheet 36 along the outer peripheral surface 46B. An arrow line, which is shown in the treatment liquid-drying processing drum 46, indicates the sheet transport direction in the treatment liquid-drying processing section 16.

The sheet 36, which is transported by the treatment liquid-drying processing drum 46, passes under the treatment liquid-drying processing drum 46. The transport guides 48 are disposed at positions below the treatment liquid-drying processing drum 46. The transport guides 48 support the sheet 36 that passes under the treatment liquid-drying processing drum 46. Here, "under" means the lower side in the direction of gravity. Further, "upper" indicates a direction opposite to the direction of gravity.

The treatment liquid-drying processing device 50 is disposed in the treatment liquid-drying processing drum 46. The treatment liquid-drying processing device 50 performs processing for drying treatment liquid on the sheet 36 that passes under the treatment liquid-drying processing drum 46 and is supported by the transport guides 48.

The sheet 36, which has passed through the processing region of the treatment liquid-drying processing device 50, is delivered to the drawing unit 18. The sheet 36, which has been subjected to the processing for drying treatment liquid by the treatment liquid-drying processing device 50, is not shown in FIG. 1.

<Drawing Unit>

The drawing unit 18 shown in FIG. 1 comprises a drawing drum 52. The drawing drum 52 has a cylindrical shape. The drawing drum 52 is supported so as to be rotatable about a central axis of the cylindrical shape as a rotating shaft 52A.

An outer peripheral surface 52B of the drawing drum 52 is provided with a plurality of suction holes. The plurality of suction holes are connected to a suction flow passage formed in the drawing drum 52. The plurality of suction holes and the suction flow passage formed in the drawing drum 52 are not shown.

The suction flow passage formed in the drawing drum 52 is connected to a suction pressure generating device. In a case where the suction pressure generating device is operated, suction pressure is generated in the plurality of suction holes provided on the outer peripheral surface 52B of the drawing drum 52. The suction pressure generating device is not shown. Examples of the suction pressure generating device include a pump.

The drawing drum 52 comprises grippers not shown in FIG. 1. Each of the grippers is denoted in FIG. 9 by Reference numeral 52C. The structure of the gripper 52C of the drawing drum 52 is the same as the structure of the gripper of the treatment liquid drum 42 and the structure of the gripper of the treatment liquid-drying processing drum 46. The description of the gripper of the drawing drum 52 will be omitted.

The grippers of the drawing drum 52 are disposed in recessed portions that are formed on the outer peripheral surface 52B of the drawing drum 52. The recessed portions formed on the outer peripheral surface 52B of the drawing drum 52 are not shown in FIG. 1. Each of the recessed portions is denoted in FIG. 9 by Reference numeral 52D.

Suction pressure, which is generated in the plurality of suction holes provided on the outer peripheral surface 52B of the drawing drum 52, acts on the sheet 36 of which the front end portion is gripped by the gripper of the drawing drum 52, so that the sheet 36 is sucked and supported on the outer peripheral surface 52B of the drawing drum 52.

The drawing drum 52 is one example of a component of a medium transport unit. The outer peripheral surface 52B of the drawing drum 52 is one aspect of a medium support surface. The gripper of the drawing drum 52 is one aspect of a grip part. Claws and claw bases of the grippers of the drawing drum 52 are examples of components of grip members.

Figure 9:
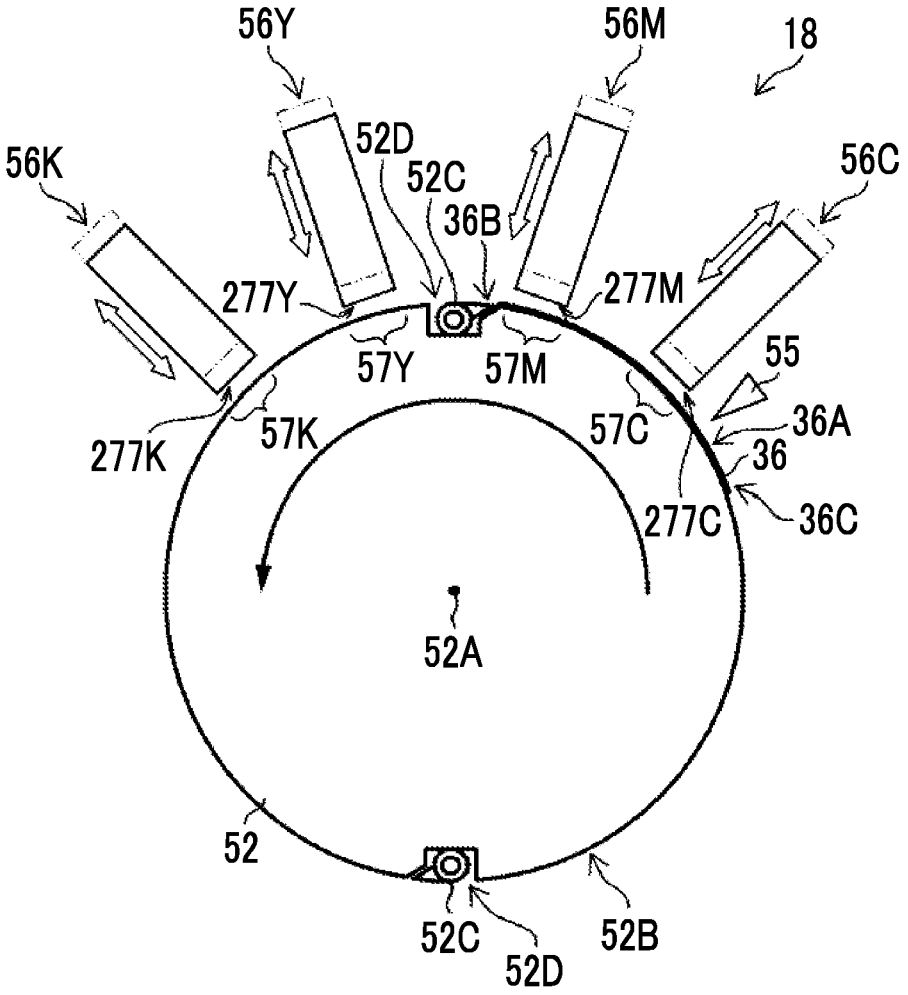
FIG. 9 is a schematic diagram showing an operation for raising/lowering liquid jet heads by the head raising/lowering units.

The sheet 36, which is sucked and supported on the outer peripheral surface 52B of the drawing drum 52, is not shown in FIG. 1. The sheet 36, which is sucked and supported on the outer peripheral surface 52B of the drawing drum 52, is shown in FIG. 9.

Since the drawing drum 52 is rotated while the sheet 36 is closely attached to the outer peripheral surface 52B, the drawing drum 52 transports the sheet 36 along the outer peripheral surface 52B. An arrow line, which is shown in the drawing drum 52, indicates the sheet transport direction in the drawing unit 18.

The drawing unit 18 shown in FIG. 1 comprises a sheet floating-detection sensor 55. The sheet floating-detection sensor 55 detects the floating of the sheet 36 that is delivered to the drawing unit 18. The sheet floating-detection sensor 55 detects the floating distance of the sheet 36.

The detection of the floating distance of the sheet 36 of this embodiment is synonymous with the measurement of the floating distance of the sheet 36. The same applies to a second embodiment to be described later. Examples of the sheet floating-detection sensor 55 include a laser range finder, an ultrasonic range finder, and a capacitive range finder.

The floating of a sheet 36 includes a state in which at least a part of the sheet 36 is away from a sheet support surface, which is the outer peripheral surface 52B of the drawing unit 18, by a distance equal to or larger than a predetermined distance due to the bending of a corner portion of the sheet 36, the curvature of the sheet 36, or the like.

The floating distance of the sheet 36 is a distance between the position of the sheet 36, which is most away from the outer peripheral surface 52B, and the outer peripheral surface 52B of the drawing drum 52 on which the sheet 36 is supported.

The sheet floating-detection sensor 55 is disposed at a position on the upstream side of a liquid jet head 56C in the sheet transport direction of the drawing unit 18. The liquid jet head 56C is disposed at the most upstream position in the drawing unit 18 in the sheet transport direction of the drawing unit 18.

The sheet floating-detection sensor 55 detects the floating of a sheet 36 immediately before the sheet 36 enters the jet region of the liquid jet head 56C. The sheet floating-detection sensor 55 is one example of a component of a first medium floating detection unit.

"Immediately before" represents a distance from the position of the liquid jet head 56C on a sheet transport path of the drawing unit 18 that allows a period between the timing of the detection of the floating of the sheet 36 and the timing of the completion of the movement of the liquid jet head 56C to a retreat position to be ensured.

The jet region of the liquid jet head 56C is a region which is positioned on the transport path of the sheet 36 and in which liquid jetted from the liquid jet head 56C lands. The jet region has certain lengths in the sheet transport direction and a sheet width direction. The jet region may be a region where the liquid jet surface of the liquid jet head 56C is projected onto the transport path of the sheet 36. The same applies to the jet regions of the other liquid jet heads of the drawing unit 18.

The jet region of the liquid jet head 56C is not shown in FIG. 1. The jet region of the liquid jet head 56C is denoted in FIG. 9 by Reference numeral 57C. Further, the reference numeral of the liquid jet surface is not shown in FIG. 1.

Figure 3:
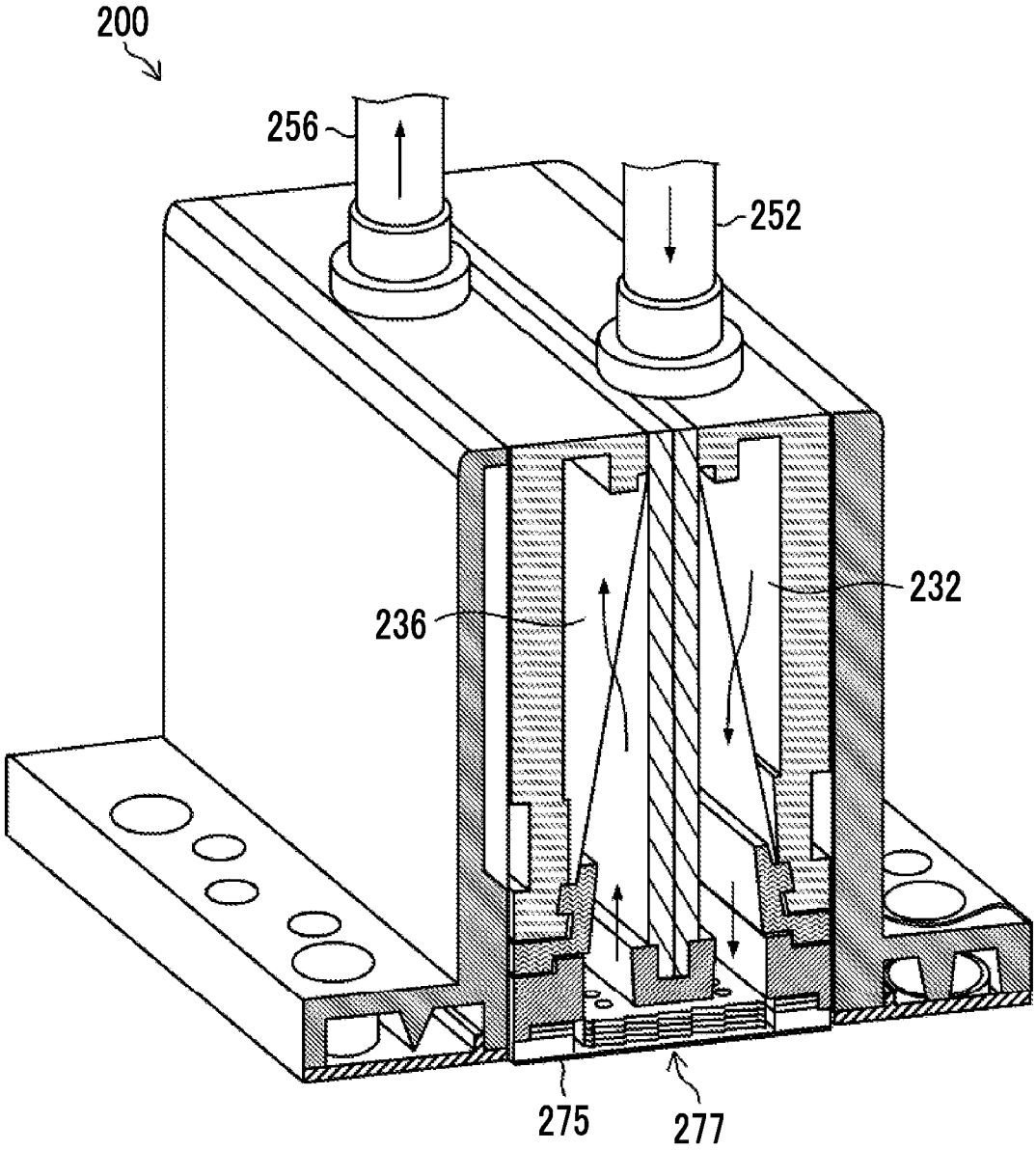
FIG. 3 is a perspective view of a head module including a partial cross-sectional view.

The liquid jet surface of the liquid jet head is denoted in FIG. 3 by Reference numeral 277. The liquid jet head, which is mentioned here, is a generic name for a liquid jet head 56C, a liquid jet head 56M, a liquid jet head 56Y, and a liquid jet head 56K shown in FIG. 1.

The liquid jet surface of the liquid jet head is a generic name for a liquid jet surface 277C of the liquid jet head 56C, a liquid jet surface 277M of the liquid jet head 56M, a liquid jet surface 277Y of the liquid jet head 56Y, and a liquid jet surface 277K of the liquid jet head 56K shown in FIG. 9.

The drawing unit 18 shown in FIG. 1 comprises the liquid jet head 56C, the liquid jet head 56M, the liquid jet head 56Y, and the liquid jet head 56K. Each of the liquid jet heads 56C, 56M, 56Y, and 56K comprises nozzle portions that jet liquid. The nozzle portion is not shown in FIG. 1. The nozzle portion is denoted in FIG. 5 by Reference numeral 281.

An alphabet, which is added to the reference numeral of the liquid jet head, represents a color. C represents cyan. M represents magenta. Y represents yellow. K represents black.

The liquid jet heads 56C, 56M, 56Y, and 56K are arranged at positions above the drawing drum 52. The liquid jet heads 56C, 56M, 56Y, and 56K are arranged along the sheet transport direction from the upstream side in the sheet transport direction in the order of the liquid jet heads 56C, 56M, 56Y, and 56K.

An ink jet system can be applied to each of the liquid jet heads 56C, 56M, 56Y, and 56K. The liquid jet heads 56C, 56M, 56Y, and 56K jet liquid onto a first surface of the sheet 36 that is transported by the drawing drum 52.

Ink jetted from the liquid jet heads 56C, 56M, 56Y, and 56K is applied to the first surface of the sheet 36, so that drawing is realized.

The first surface of the sheet 36 is a surface of the sheet 36 that is opposite to a second surface of the sheet 36 supported by the drawing drum 52. The reference numeral of the first surface of the sheet 36 and the reference numeral of the second surface of the sheet 36 are not shown. The first surface of the sheet 36 is denoted in FIG. 9 by Reference numeral 36A. The first surface of the sheet 36 is called a surface, a drawing surface, or the like. The second surface of the sheet 36 is called a back, a surface to be supported, or the like.

The liquid jet heads 56C, 56M, 56Y, and 56K are mounted on head raising/lowering units and horizontal head moving units. The head raising/lowering units and the horizontal head moving units are not shown in FIG. 1. The head raising/lowering unit is denoted in FIGS. 6 to 8 by Reference numeral 400. The details of the head raising/lowering unit will be described later.

The drawing unit 18 shown in FIG. 1 comprises an in-line sensor 58. The in-line sensor 58 is disposed at a position on the downstream side of the liquid jet head 56K in the sheet transport direction of the drawing unit 18. The liquid jet head 56K is disposed at the most downstream position in the drawing unit 18 in the sheet transport direction of the drawing unit 18.

The in-line sensor 58 comprises an imaging element, a peripheral circuit of the imaging element, and a light source. The imaging element, the peripheral circuit of the imaging element, and the light source are not shown. A solid-state imaging element, such as a CCD image sensor or a CMOS image sensor, can be applied as the imaging element. CCD is an abbreviation for Charge Coupled Device. CMOS is an abbreviation for Complementary Metal-Oxide Semiconductor.

The peripheral circuit of the imaging element comprises a processing circuit for an output signal of the imaging element. Examples of the processing circuit include a filter circuit that removes noise components from the output signal of the imaging element, an amplifier circuit, a waveform shaping circuit, and the like. The filter circuit, the amplifier circuit, or the waveform shaping circuit is not shown.

The light source is disposed at a position where the light source can irradiate an object, which is to be read by the in-line sensor 58, with illumination light. An LED, a lamp, or the like can be applied as the light source. LED is an abbreviation for light emitting diode.

Figure 8:
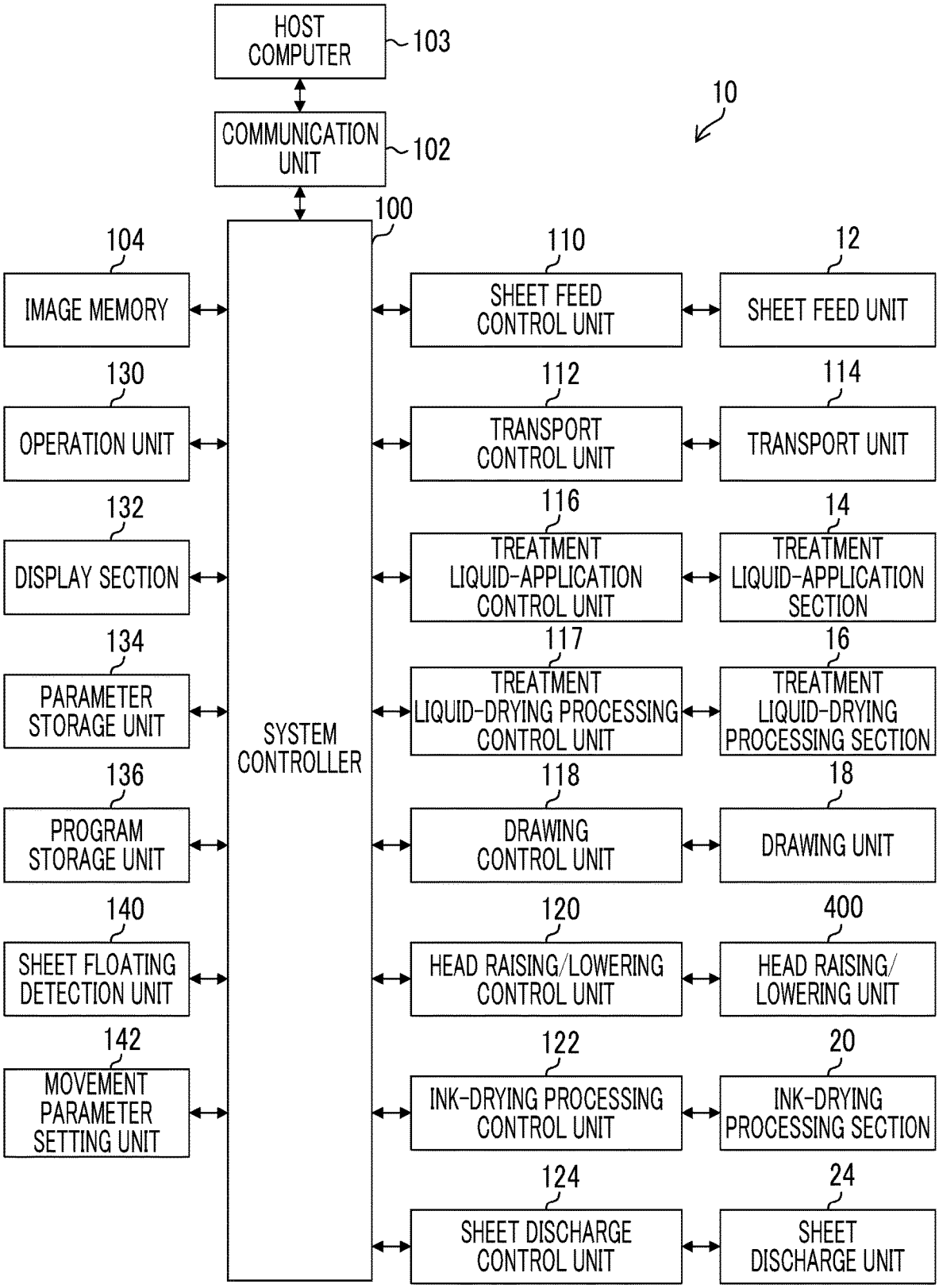
FIG. 8 is a block diagram showing the schematic configuration of a control system.

An imaging signal, which is output from the in-line sensor 58, is sent to the system controller 100 shown in FIG. 8. An imaging signal, which is output from the in-line sensor 58, can be applied for the detection of abnormalities of the liquid jet heads 56C, 56M, 56Y, and 56K shown in FIG. 1, the detection of density unevenness, and the like. The sheet 36 subjected to drawing in the drawing unit 18 is delivered to the ink-drying processing section 20. The sheet 36 subjected to drawing in the drawing unit 18 is not shown.

<Ink-Drying Processing Section>

The ink-drying processing section 20 shown in FIG. 1 comprises a drying processing device 21 and a sheet transport member 22. The drying processing device 21 is disposed at a position above the sheet transport member 22 that transports a sheet in the ink-drying processing section 20.

The drying processing device 21 performs drying processing on the sheet 36 to which liquid is made to adhere by the drawing unit 18 and which is transported by the sheet transport member 22. A heater that radiates heat or a fan that generates wind can be applied as the drying processing device 21. The drying processing device 21 may comprise both a heater and a fan. An infrared heater, an ultraviolet lamp, or the like can be applied as the heater.

The sheet transport member 22 transports the sheet 36 in the ink-drying processing section 20. A chain transport, a belt transport, a roller transport, or the like can be applied as the sheet transport member 22. The sheet 36, which has been subjected to drying processing by the drying processing device 21, is delivered to the sheet discharge unit 24. The sheet 36, which is subjected to the processing for drying ink by the ink-drying processing section 20, is not shown in FIG. 1.

<Sheet Discharge Unit>

The sheet 36, which has been subjected to drying processing by the ink-drying processing section 20, is stored in the sheet discharge unit 24 shown in FIG. 1. The sheet 36, which is stored in the sheet discharge unit 24, is not shown. The sheet discharge unit 24 may classify a sheet 36 that has been subjected to normal drawing and a sheet 36 that is a waste sheet, and may separately store the sheet 36 that has been subjected to normal drawing and the waste sheet.

The ink jet recording apparatus 10, which comprises the treatment liquid-application section 14 and the treatment liquid-drying processing section 16, is shown in FIG. 1, but the treatment liquid-application section 14 and the treatment liquid-drying processing section 16 may be omitted.

[Structure of Liquid Jet Head]

Next, the structures of the liquid jet heads shown in FIG. 1 will be described in detail.

<Overall Structure>

Figure 2:
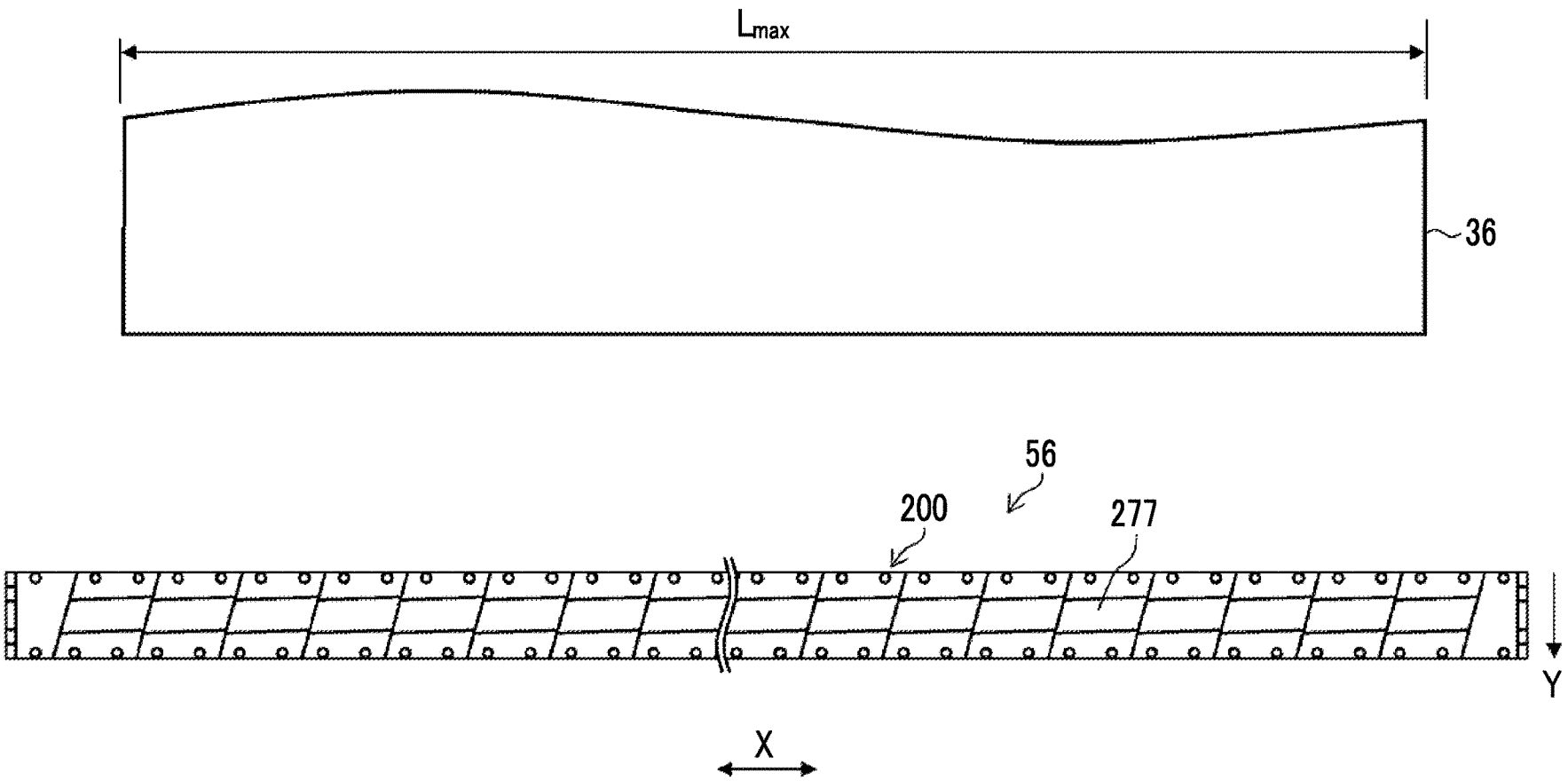
FIG. 2 is a perspective plan view of the liquid jet surface of a liquid jet head.

FIG. 2 is a perspective plan view of the liquid jet surface of the liquid jet head. The same structure can be applied to the liquid jet head 56C for jetting a cyan ink, the liquid jet head 56M for jetting a magenta ink, the liquid jet head 56Y for jetting a yellow ink, and the liquid jet head 56K for jetting a black ink that are shown in FIG. 1.

In a case where the liquid jet heads 56C, 56M, 56Y, and 56K do not need to be distinguished from each other, the liquid jet heads are denoted by Reference numeral 56.

As shown in FIG. 2, the liquid jet head 56 is a line type head. The line type head has a structure in which a plurality of nozzle portions are arranged over a length exceeding the entire width L. of the sheet 36 in the sheet width direction as a direction orthogonal to the sheet transport direction. The nozzle portions are not shown in FIG. 2. The nozzle portion is denoted in FIG. 5 by Reference numeral 281.

Reference numeral X shown in FIG. 2 denotes the sheet width direction. Reference numeral Y shown in FIG. 2 denotes the sheet transport direction. In this specification, the sheet width direction can be replaced with the X direction. Further, a direction orthogonal to the sheet transport direction can be replaced with the X direction.

The sheet transport direction can be replaced with the transport direction of a sheet. The sheet transport direction can be replaced with a Y direction. The sheet transport direction is one aspect of the medium transport direction.

The liquid jet head 56 shown in FIG. 2 comprises a plurality of head modules 200. The plurality of head modules 200 are arranged in a line along the sheet width direction. The same structure may be applied to the plurality of head modules 200. Further, the head module 200 may have a structure that can function alone as a liquid jet head.

The liquid jet head 56 in which the plurality of head modules 200 are arranged in a line along the sheet width direction is shown in FIG. 2, but the plurality of head modules 200 may be arranged in two lines in a zigzag pattern so that the phases of the head modules 200 are shifted from each other in the sheet transport direction.

A plurality of nozzle openings are arranged on the liquid jet surfaces 277 of the head modules 200. The nozzle openings are not shown in FIG. 2. The nozzle openings are denoted in FIG. 4 by Reference numeral 280. In this specification, the liquid jet surface 277 of the head module 200 can be replaced with the liquid jet surface 277 of the liquid jet head 56.

The full-line type liquid jet head 56 is exemplified in this embodiment, but the liquid jet head 56 may be a serial type liquid jet head. A serial type liquid jet head has the entire length that is shorter than the entire width $L_{max}$ of the sheet 36 in the sheet width direction.

Drawing using a serial type liquid jet head is realized according to the following procedure. The serial type liquid jet head is moved in the sheet width direction to perform drawing corresponding to one time in the sheet width direction. After the drawing corresponding to one time in the sheet width direction, the sheet 36 is transported in the sheet transport direction by a certain distance. Drawing in the sheet width direction is performed in the next region. This operation is repeated to form an image on the entire surface of the sheet.

<Example of Structure of Head Module>

Figure 4:
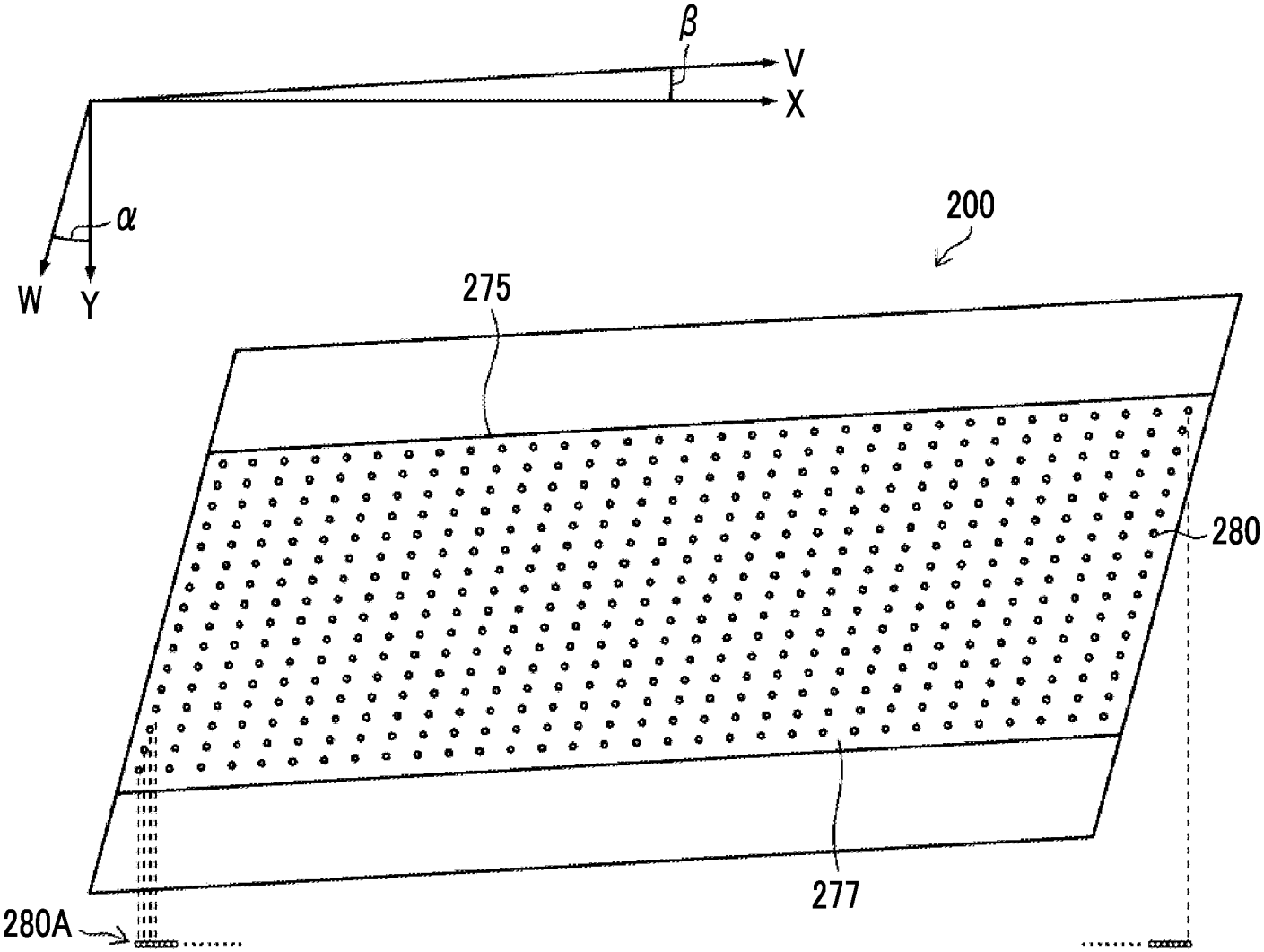
FIG. 4 is a plan perspective view of the liquid jet surface of the head module.

FIG. 3 is a perspective view of the head module including a partial cross-sectional view. FIG. 4 is a plan perspective view of the liquid jet surface of the head module.

The head module 200 shown in FIG. 3 comprises an ink supply unit. The ink supply unit comprises an ink supply chamber 232 and an ink circulation chamber 236. The ink supply chamber 232 and the ink circulation chamber 236 are disposed at positions on the side opposite to a liquid jet surface 277 of a nozzle plate 275.

The ink supply chamber 232 is connected to an ink tank (not shown) through a supply-side individual flow passage 252. The ink circulation chamber 236 is connected to a collection tank (not shown) through a collection-side individual flow passage 256.

A plurality of nozzle openings 280 are two-dimensionally arranged on the liquid jet surface 277 of the nozzle plate 275 of one head module 200. Only some of the nozzle openings 280 are shown in FIG. 4.

The head module 200 has the planar shape of a parallelogram that has a long-side end face extending in a V direction having an inclination of an angle β with respect to the X direction and a short-side end face extending in a W direction having an inclination of an angle α with respect to the Y direction, and the plurality of nozzle openings 280 are arranged in the form of a matrix in a row direction parallel to the V direction and a column direction parallel to the W direction.

The arrangement of the nozzle openings 280 is not limited to the aspect shown in FIG. 4, and the plurality of nozzle openings 280 may be arranged in a row direction parallel to the X direction and a column direction obliquely crossing the X direction.

Here, the matrix arrangement of the nozzle openings 280 is the arrangement of the nozzle openings 280 where the intervals between the nozzle openings 280 are uniform in an X-direction projection nozzle array 280A where the plurality of nozzle openings 280 are arranged along the X direction in a case where the plurality of nozzle openings 280 are projected to the X direction.

In the liquid jet head 56 shown in this embodiment, nozzle openings 280 belonging to one head module 200 and nozzle openings 280 belonging to the other head module 200 are mixed at a connecting portion between the adjacent head modules 200 in the X-direction projection nozzle array.

In a case where there is no error in the mounting position of each head module 200, the nozzle openings 280, which belong to one head module 200, and the nozzle openings 280, which belong to the other head module 200, of a connecting region are arranged at the same positions. Accordingly, the arrangement of the nozzle openings 280 is uniform even in the connecting region.

In the following description, it is assumed that the head modules 200 of the liquid jet head 56 are mounted with no error in the mounting positions thereof. The nozzle portions are not shown in FIG. 4. The nozzle portion is denoted in FIG. 5 by Reference numeral 281.

<Internal Structure of Head Module>

Figure 5:
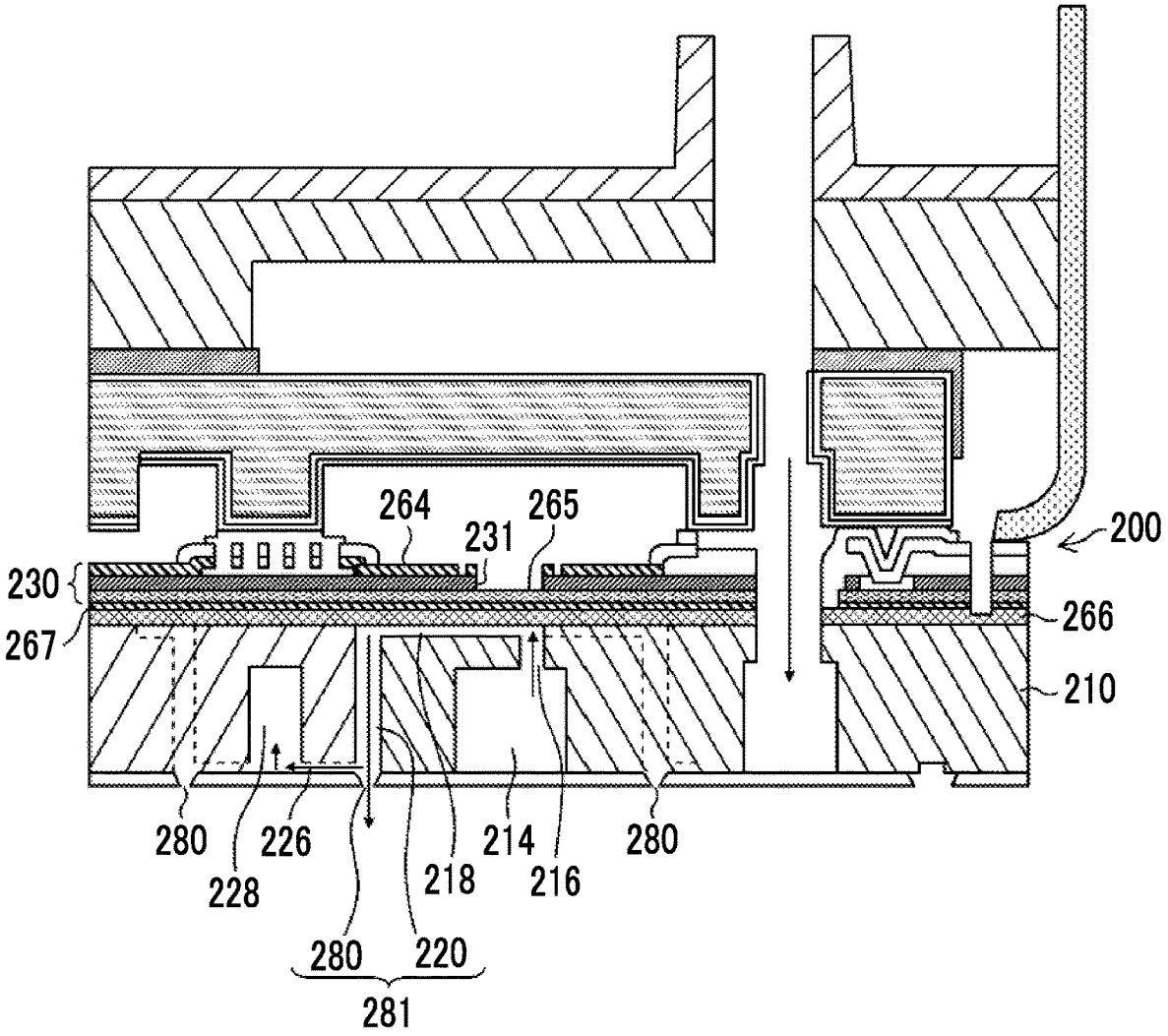
FIG. 5 is a cross-sectional view showing the internal structure of the head module.

FIG. 5 is a cross-sectional view showing the internal structure of the head module. The head module 200 comprises an ink supply passage 214, individual supply passages 216, pressure chambers 218, nozzle communication passages 220, individual circulation flow passages 226, a common circulation flow passage 228, piezoelectric elements 230, and a vibrating plate 266.

The ink supply passage 214, the individual supply passages 216, the pressure chambers 218, the nozzle communication passages 220, the individual circulation flow passages 226, and the common circulation flow passage 228 are formed in a flow passage structure 210. The nozzle portion 281 may comprise the nozzle opening 280 and the nozzle communication passage 220.

The individual supply passage 216 is a flow passage that connects the pressure chamber 218 to the ink supply passage 214. The nozzle communication passage 220 is a flow passage that connects the pressure chamber 218 to the nozzle opening 280. The individual circulation flow passage 226 is a flow passage that connects the nozzle communication passage 220 to the common circulation flow passage 228.

The vibrating plate 266 is provided on the flow passage structure 210. The piezoelectric elements 230 are disposed on the vibrating plate 266 with an adhesive layer 267 therebetween. The piezoelectric element 230 has a structure in which a lower electrode 265, a piezoelectric layer 231, and an upper electrode 264 are laminated. The lower electrode 265 is called a common electrode, and the upper electrode 264 is called an individual electrode.

The upper electrode 264 is formed of an individual electrode that is patterned so as to correspond to the shape of each pressure chamber 218, and the piezoelectric element 230 is provided for each pressure chamber 218.

The ink supply passage 214 is connected to the ink supply chamber 232 shown in FIG. 3. Ink is supplied to the pressure chamber 218 from the ink supply passage 214 shown in FIG. 5 through the individual supply passage 216. In a case where a drive voltage is applied to the upper electrode 264 of the piezoelectric element 230 to be operated according to image data, the piezoelectric element 230 and the vibrating plate 266 are deformed and the volume of the pressure chamber 218 is changed.

The head module 200 can jet liquid droplets from the nozzle openings 280 through the nozzle communication passages 220 due to a change in pressure that is caused by a change in the volume of the pressure chamber 218. In this specification, the jet of liquid and the jet of liquid droplets can be replaced with each other.

In a case where the drive of the piezoelectric elements 230 corresponding to the respective nozzle openings 280 is controlled according to dot data that is generated from the image data, the head module 200 can jet liquid droplets from the nozzle openings 280.

Since jet timings of liquid droplets from the respective nozzle openings 280 shown in FIG. 4 are controlled according to the transport speed of a sheet 36 while the sheet 36 shown in FIG. 2 is transported in the sheet transport direction at a certain speed, a desired image is formed on the sheet 36.

Although not shown, the planar shape of the pressure chamber 218 provided so as to correspond to each nozzle opening 280 is a substantially square shape, an outlet, which is to be connected to the nozzle opening 280, is provided at one corner portion of both corner portions positioned on a diagonal line, and the individual supply passage 216, which is an inlet for ink to be supplied, is provided at the other corner portion thereof.

The shape of the pressure chamber is not limited to a square shape. The planar shape of the pressure chamber may be various shapes, such as a quadrangular shape (a rhombic shape, a rectangular shape, and the like), a pentagonal shape, a hexagonal shape, other polygonal shapes, a circular shape, an elliptical shape, and the like.

A circulation outlet (not shown) is formed at the nozzle portion 281 that includes the nozzle opening 280 and the nozzle communication passage 220. The nozzle portion 281 communicates with the individual circulation flow passage 226 through the circulation outlet. Ink, which is not used for jetting, of ink of the nozzle portion 281 is collected to the common circulation flow passage 228 through the individual circulation flow passage 226.

The common circulation flow passage 228 is connected to the ink circulation chamber 236 shown in FIG. 3. Since ink is normally collected to the common circulation flow passage 228 through the individual circulation flow passage 226 shown in FIG. 5, the thickening of ink of the nozzle portion 281 during a period where ink is not jetted is prevented. The thickening represents a state where the viscosity of liquid is increased.

The piezoelectric element 230 having a structure individually separated so as to correspond to each nozzle portion 281 is exemplified in FIG. 5 as an example of a piezoelectric element. A structure in which the piezoelectric layer 231 is integrally formed so as to correspond to the plurality of nozzle portions 281, the individual electrode is formed so as to correspond to each nozzle portion 281, and an active region is formed for each nozzle portion 281 may be applied to the piezoelectric element.

The head module 200 may comprise a heater, which is provided in the pressure chamber 218, as a pressure generating element instead of the piezoelectric element. A thermal system, which supplies a drive voltage to the heater to allow the heater to generate heat and uses a film boiling phenomenon to jet ink present in the pressure chamber 218 from the nozzle opening 280, may be applied to the head module 200.

<Description of Head Raising/Lowering Unit>

Figure 6:
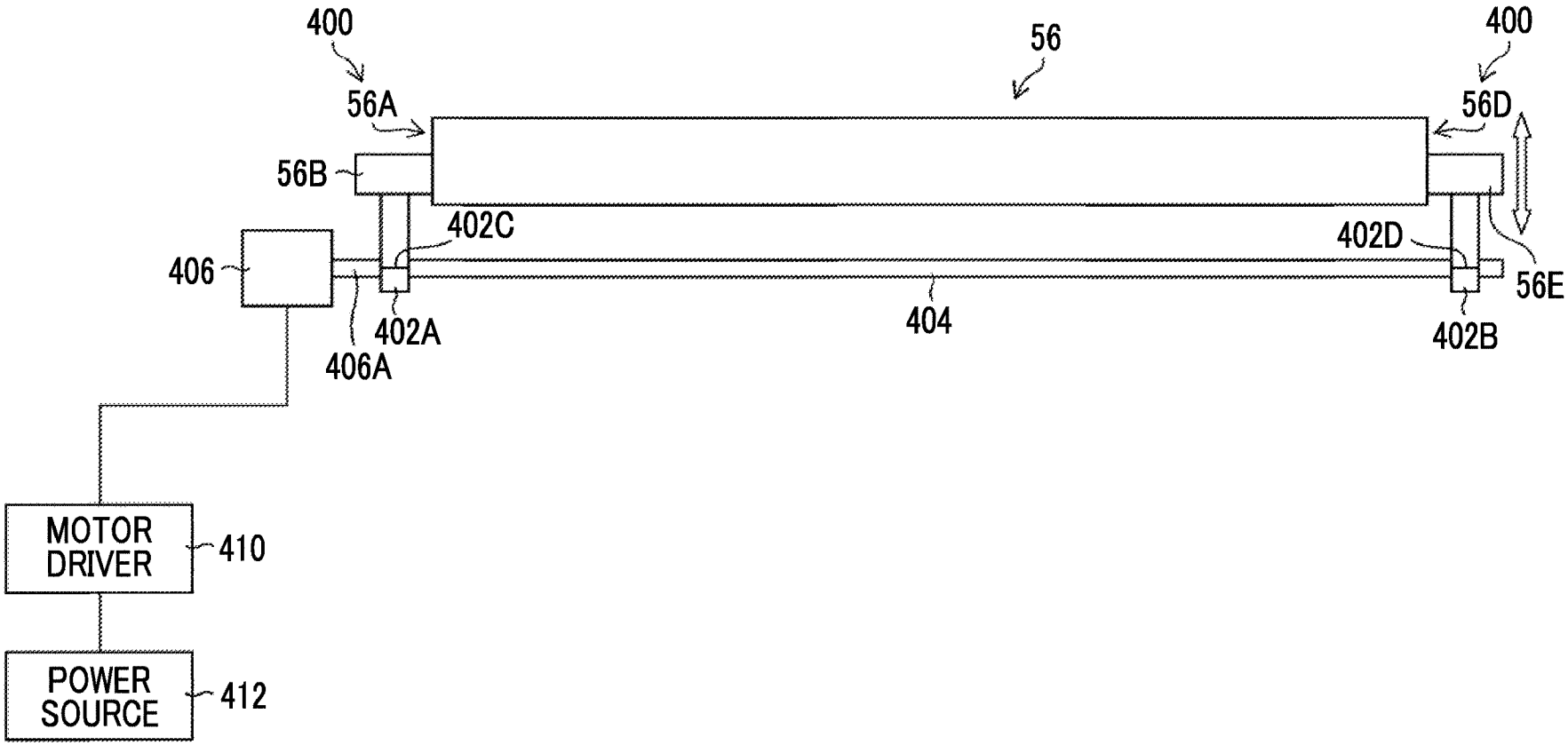
FIG. 6 is a schematic diagram showing the schematic configuration of a head raising/lowering unit.
Figure 7:
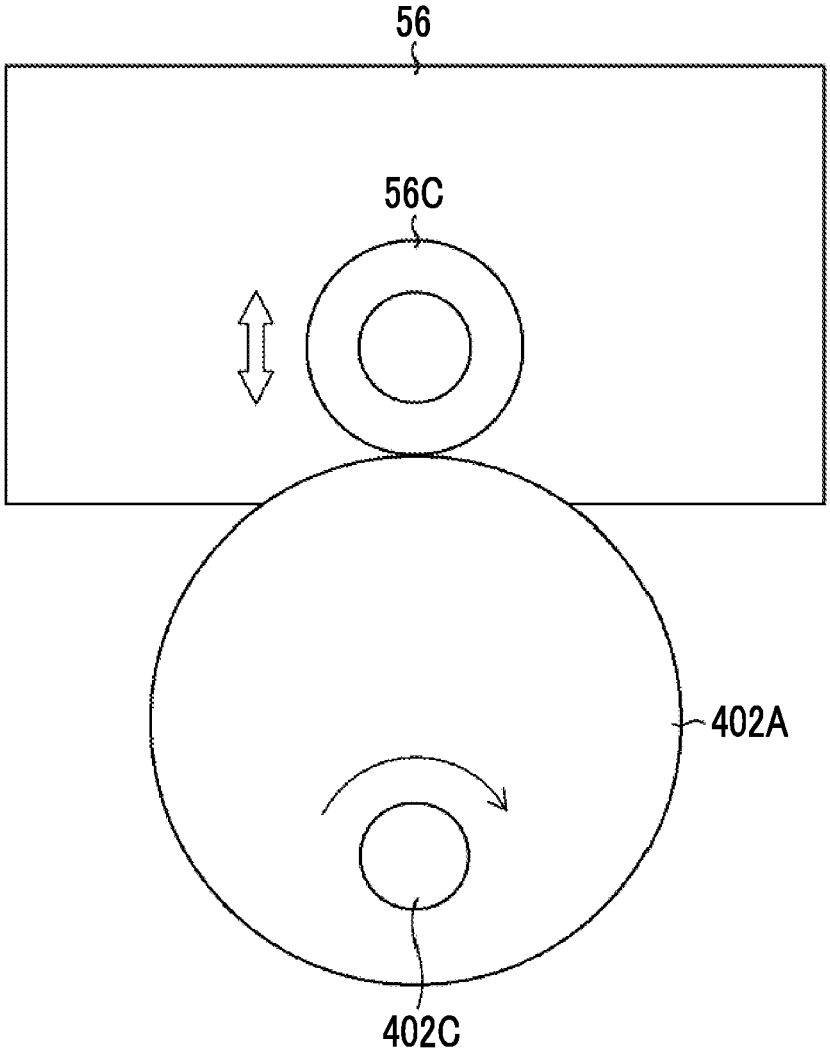
FIG. 7 is a diagram showing the head raising/lowering unit shown in FIG. 6 that is viewed from one end of the liquid jet head in a longitudinal direction.

FIG. 6 is a schematic diagram showing the schematic configuration of the head raising/lowering unit. FIG. 7 is a diagram showing the head raising/lowering unit 400 shown in FIG. 6 that is viewed from one end of the liquid jet head in a longitudinal direction. The head raising/lowering units 400 having the same structure can be applied to the liquid jet heads 56C, 56M, 56Y, and 56K shown in FIG. 1.

The longitudinal direction of the liquid jet head 56 is a direction parallel to the sheet width direction in a state where the liquid jet head 56 is mounted on the ink jet recording apparatus 10 shown in FIG. 1. In this specification, the longitudinal direction of the liquid jet head 56 can be replaced with the sheet width direction.

The head raising/lowering unit 400 shown in FIG. 6 comprises an eccentric cam 402A, an eccentric cam 402B, and a cam shaft 404. The eccentric cam 402A is disposed at a position where the eccentric cam 402A supports a bearing 56B mounted on one end 56A of the liquid jet head 56 in the longitudinal direction. Further, the eccentric cam 402B is disposed at a position where the eccentric cam 402B supports a bearing 56E mounted on the other end 56D of the liquid jet head 56 in the longitudinal direction.

The eccentric cams 402A and 402B are connected to each other by the cam shaft 404. The cam shaft 404 is connected to a rotating shaft 402C of the eccentric cam 402A and a rotating shaft 402D of the eccentric cam 402B.

The rotating shaft 402C of the eccentric cam 402A is connected to a rotating shaft 406A of a motor 406. The rotating shaft 402C of the eccentric cam 402A and the rotating shaft 406A of the motor 406 are connected to each other by a connecting member (not shown). Examples of the connecting member include a coupling, a bearing, a belt, a gear, and the like.

The motor 406 is electrically connected to a motor driver 410. Power is supplied to the motor driver 410 from a power source 412. The motor driver 410 is connected to a controller (not shown) so as to be capable of communicating with the controller.

A command signal is sent to the motor driver 410 from the controller (not shown). The motor driver 410 supplies power to the motor 406 on the basis of the command signal. The motor 406 is driven on the basis of the command signal.

In a case where the rotating shaft 406A of the motor 406 is rotated, the eccentric cams 402A and 402B are rotated. The liquid jet head 56 is raised and lowered according to the rotation of the eccentric cams 402A and 402B. Arrow lines shown in FIGS. 6 and 7 indicate the moving direction of the liquid jet head 56. An upward direction represents a raising direction. A downward direction represents a lowering direction.

A first head raising/lowering unit is a raising/lowering unit for a liquid jet head that is a first liquid jet head among the liquid jet heads 56C, 56M, and 56Y shown in FIG. 1. A second head raising/lowering unit is a raising/lowering unit for a liquid jet head that is a second liquid jet head among the liquid jet heads 56M, 56Y, and 56K shown in FIG. 1. A third head raising/lowering unit is a raising/lowering unit for a liquid jet head that is a third liquid jet head between the liquid jet heads 56Y and 56K shown in FIG. 1.

[Description of Control System]

FIG. 8 is a block diagram showing the schematic configuration of a control system. As shown in FIG. 8, the ink jet recording apparatus 10 comprises the system controller 100. The system controller 100 may comprise a CPU, a ROM, and a RAM.

CPU is an abbreviation for Central Processing Unit. ROM is an abbreviation for Read Only Memory. RAM is an abbreviation for Random Access Memory.

The system controller 100 functions as a total control section that generally controls the respective parts of the ink jet recording apparatus 10. Further, the system controller 100 functions as a calculation section that performs various kinds of calculation processing. Furthermore, the system controller 100 functions as a memory controller that controls the reading of data of a memory and the writing of data.

The ink jet recording apparatus 10 shown in FIG. 8 comprises a communication unit 102 and an image memory 104. The communication unit 102 comprises a communication interface (not shown). The communication unit 102 can transmit and receive data to and from a host computer 103 connected to the communication interface.

The image memory 104 functions as a temporary storage section for various kinds of data including image data. Data is read from and written in the image memory 104 through the system controller 100. Image data, which is taken from the host computer 103 through the communication unit 102, is temporarily stored in the image memory 104.

The ink jet recording apparatus 10 shown in FIG. 8 comprises a sheet feed control unit 110, a transport control unit 112, a treatment liquid-application control unit 116, a treatment liquid-drying processing control unit 117, a drawing control unit 118, a head raising/lowering control unit 120, an ink-drying processing control unit 122, and a sheet discharge control unit 124.

The sheet feed control unit 110 allows the sheet feed unit 12 to be operated according to a command sent from the system controller 100. The sheet feed control unit 110 controls an operation for starting feeding the sheet 36, an operation for stopping feeding the sheet 36, and the like.

The transport control unit 112 controls the operation of a transport unit 114 for the sheet 36 in the ink jet recording apparatus 10. The transport unit 114 shown in FIG. 8 includes the treatment liquid drum 42, the treatment liquid-drying processing drum 46, the drawing drum 52, and the sheet transport member 22 shown in FIG. 1.

The treatment liquid-application control unit 116 allows the treatment liquid-application section 14 to be operated according to a command sent from the system controller 100. The treatment liquid-application control unit 116 controls the amount of treatment liquid to be applied, a treatment liquid-application timing, and the like.

The treatment liquid-drying processing control unit 117 allows the treatment liquid-drying processing section 16 to be operated according to a command sent from the system controller 100. The treatment liquid-drying processing control unit 117 controls drying temperature, the flow rate of dry gas, the injection timing of dry gas, and the like.

The drawing control unit 118 controls the operation of the drawing unit 18 according to a command sent from the system controller 100. That is, the drawing control unit 118 controls the jet of ink from the liquid jet heads 56C, 56M, 56Y, and 56K shown in FIG. 1.

The drawing control unit 118 comprises an image processing section (not shown). The image processing section generates dot data from input image data. The image processing section comprises a color separation processing section, a color conversion processing section, a correction processing section, and a halftoning section (not shown). The color separation processing section, the color conversion processing section, the correction processing section, and the halftoning section are not shown.

The color separation processing section performs color separation processing on the input image data. For example, in a case where the input image data is represented in RGB, the input image data is separated into data of the respective colors of R, G, and B. Here, R represents red. G represents green. B represents blue.

The color conversion processing section converts image data, which are separated into the data of R, G, and B and correspond to the respective colors, into image data that are represented using C, M, Y, and K corresponding to the colors of inks. Here, C represents cyan. M represents magenta. Y represents yellow. K represents black.

The correction processing section performs correction processing on the image data that are converted into C, M, Y, and K and correspond to the respective colors. Examples of the correction processing include gamma correction processing, processing for correcting density unevenness, processing for correcting an abnormal recording element, and the like.

The halftoning section converts image data, which are represented by multiple numbers of gradations in the range of, for example, 0 to 255, into dot data that are represented by a binary value or a multi-level value that is a ternary value or more and is smaller than the number of gradations of the input image data.

In the halftoning section, a predetermined halftoning rule is applied. Examples of the halftoning rule include a dither method, an error diffusion method, and the like. The halftoning rule may be changed according to image recording conditions, the contents of image data, or the like.

The drawing control unit 118 comprises a waveform generation unit, a waveform storage unit, and a drive circuit (not shown). The waveform generation unit generates a waveform of a drive voltage. The waveform of the drive voltage is stored in the waveform storage unit. The drive circuit generates a drive voltage having a drive waveform corresponding to dot data. The drive circuit supplies the drive voltage to the liquid jet heads 56C, 56M, 56Y, and 56K shown in FIG. 1.

That is, the drawing control unit 118 determines a jet timing and the amount of ink to be jetted at the position of each pixel on the basis of dot data generated through the processing performed by the image processing section, generates a drive voltage corresponding to the jet timing and the amount of ink to be jetted at the position of each pixel and a control signal determining the jet timing at each pixel, and supplies the drive voltage to the liquid jet heads. Ink jetted from the liquid jet heads forms dots.

The head raising/lowering control unit 120 shown in FIG. 8 allows each head raising/lowering unit 400 to be operated according to a command sent from the system controller 100. The head raising/lowering control unit 120 comprises the motor driver 410 and the power source 412 shown in FIG. 6 and a controller (not shown).

The head raising/lowering control unit 120 may be divided into a first head raising/lowering control unit that controls the operation of the first head raising/lowering unit and a second head raising/lowering control unit that controls the operation of the second head raising/lowering unit. The head raising/lowering control unit 120 may include a third head raising/lowering control unit that controls the operation of the third head raising/lowering unit.

The head raising/lowering control unit 120 may use a head position sensor (not shown) to detect whether the position of each of the liquid jet heads 56C, 56M, 56Y, and 56K shown in FIG. 1 is a jet position or a retreat position. The detail of the raising/lowering control of the liquid jet head using the head raising/lowering control unit 120 will be described later.

The ink-drying processing control unit 122 allows the ink-drying processing section 20 to be operated according to a command sent from the system controller 100. The ink-drying processing control unit 122 controls the temperature of dry gas, the flow rate of dry gas, the injection timing of dry gas, or the like.

The sheet discharge control unit 124 allows the sheet discharge unit 24 to be operated according to a command sent from the system controller 100. The sheet discharge control unit 124 may control the sorting of a sheet 36 that is subjected to normal drawing and a sheet 36 that is determined as a waste sheet.

The ink jet recording apparatus 10 shown in FIG. 8 comprises an operation unit 130 and a display section 132. The operation unit 130 comprises an operation member, such as an operation button, a keyboard, or a touch panel. The operation unit 130 may include plural kinds of operation members. The operation member is not shown.

Information, which is input through the operation unit 130, is sent to the system controller 100. The system controller 100 allows the respective part of the apparatus to perform various kinds of processing according to the information that is sent from the operation unit 130.

The display section 132 comprises a display device, such as a liquid crystal panel, and a display driver. The display device and the display driver are not shown. The display section 132 allows the display device to display various kinds of information, such as various kinds of configuration information of the apparatus and information on abnormalities of the apparatus, according to a command sent from the system controller 100.

The ink jet recording apparatus 10 shown in FIG. 8 comprises a parameter storage unit 134 and a program storage unit 136. Various parameters, which are used in the ink jet recording apparatus 10, are stored in the parameter storage unit 134. Various parameters, which are stored in the parameter storage unit 134, are read through the system controller 100 and are set in the respective parts of the apparatus.

Programs, which are used in the respective parts of the ink jet recording apparatus 10, are stored in the program storage unit 136. Various programs, which are stored in the program storage unit 136, are read through the system controller 100 and can be executed in the respective parts of the apparatus.

The ink jet recording apparatus 10 shown in FIG. 8 comprises a sheet floating detection unit 140. The sheet floating detection unit 140 includes the sheet floating-detection sensor 55 shown in FIG. 1. The sheet floating detection unit 140 determines whether or not the floating of a sheet 36 having passed through a detection region of the sheet floating-detection sensor 55 occurs on the basis of an output signal of the sheet floating-detection sensor 55. Further, the sheet floating-detection sensor 55 detects the floating distance of the sheet 36.

The sheet floating detection unit 140 sends the detection information on a sheet 36, of which the floating occurs, to the system controller 100. The detection information on the sheet 36 includes the floating distance of the sheet 36.

In a case where the system controller 100 acquires the detection information on the sheet 36 of which the floating occurs, the system controller 100 sends commands, which allow the liquid jet heads 56M, 56Y, and 56K shown in FIG. 1 to move to the retreat positions, to the head raising/lowering control unit 120. The sheet floating detection unit 140 is one aspect of a medium floating detection unit.

The ink jet recording apparatus 10 shown in FIG. 8 comprises a movement parameter setting unit 142. The movement parameter setting unit 142 sets movement parameters that are applied at the time of a retreat operation and return operation of the liquid jet head 56. The movement parameters, which are set using the movement parameter setting unit 142, are stored in the parameter storage unit 134.

The movement parameter setting unit 142 shown in FIG. 8 may be divided into a first movement parameter setting unit that sets first movement parameters of the first liquid jet head and a second movement parameter setting unit that sets second movement parameters of the second liquid jet head. The movement parameter setting unit 142 shown in FIG. 8 may include a third movement parameter setting unit that sets third movement parameters of the third liquid jet head.

Various processing sections are enumerated in FIG. 8 for the respective functions. Various processing sections shown in FIG. 8 can be properly integrated, separated, used for multiple purposes, or omitted.

Hardware structures of the various processing sections shown in FIG. 8 are various processors to be described below. Various processors include a CPU, a PLD, an ASIC, and the like. As examples of the processing sections, the various processing sections shown in FIG. 8 substantially takes charge of processing but may not have the term of "processing section" in the names thereof. Cases where terms, such as a control unit, an execution unit, and a determination unit, are used are also included in the concept of various processing sections.

Examples of the various processing sections shown in FIG. 8 include the sheet feed control unit 110, the transport control unit 112, the drawing control unit 118, and the like.

The control unit includes a processing unit that is written in English. The processor includes a processor that is written in English.

A CPU is a general-purpose processor that functions as various processing sections by executing software. The software can be replaced with programs. A PLD is a processor of which the circuit configuration can be changed after manufacture. Examples of the PLD include an FPGA. PLD is an abbreviation for Programmable Logic Device. FPGA is abbreviation for Field Programmable Gate Array.

An ASIC is a processor or a dedicated electrical circuit that has circuit configuration designed for exclusive use to perform specific processing. ASIC is an abbreviation for Application Specific Integrated Circuit.

One processing section may be formed of one of the above-mentioned various processors. One processing section may be formed using two or more processors of the same kind or two or more processors of different kinds. Examples of the two or more processors of the same kind include a plurality of FPGAs. Examples of the two or more processors of different kinds include a combination of a CPU and an FPGA.

Further, a plurality of processing sections may be formed using one processor. Examples of an aspect in which a plurality of processing sections are formed using one processor include an aspect in which one processor is formed using a combination of software and one or more CPUs and functions as a plurality of processing sections. Specific examples thereof include computers, such as a server and a client.

Other examples of an aspect in which a plurality of processing sections are formed using one processor include an aspect in which a processor achieving the functions of the entire system including a plurality of processing sections by one IC chip is used. Specific examples thereof include a system-on-chip. The system-on-chip includes SystemOn-Chip or SoC that is written in English. IC is an abbreviation for Integrated Circuit.

As described above, the various processing sections shown in FIG. 8 are formed using one or more of the above-mentioned various processors as hardware structures.

More specifically, the hardware structures of the above-mentioned various processors are electrical circuits where circuit elements, such as semiconductor elements, are combined. The electrical circuit includes circuitry that is written in English.

Specific examples of the various storage units shown in FIG. 8 include a memory, a storage element, or a storage device. Examples of the program storage unit 136 shown in FIG. 8 include a storage device in which various programs are stored.

[Description of Method of Coping with Floating of Sheet According to First Embodiment]

FIG. 9 is a schematic diagram showing an operation for raising/lowering the respective liquid jet heads by the head raising/lowering units. The operation for raising/lowering the liquid jet head includes a retreat operation for raising the liquid jet head from the jet position to move the liquid jet head to the retreat position, and a return operation for lowering the liquid jet head from the retreat position to move the liquid jet head to the jet position.

The jet position of the liquid jet head is the position of the liquid jet head where the liquid jet head jets liquid toward a medium. The jet position of the liquid jet head is prescribed using a distance between the liquid jet head and the outer peripheral surface 52B of the drawing drum 52 in the moving direction.

Examples of the jet position of the liquid jet head 56C include a position where a distance between the outer peripheral surface 52B of the drawing drum 52 and the liquid jet surface 277C of the liquid jet head 56C is 2 mm or less. The same applies to the liquid jet heads 56M, 56Y, and 56K.

The retreat position of the liquid jet head is the position of the liquid jet head where the collision between the liquid jet head and the sheet 36 can be avoided. The jet position of the liquid jet head is prescribed using a distance between the liquid jet head and the outer peripheral surface 52B of the drawing drum 52 in the moving direction.

Examples of the retreat position of the liquid jet head 56C include a position where a distance between the outer peripheral surface 52B of the drawing drum 52 and the liquid jet surface 277C of the liquid jet head 56C exceeds 2 mm. The same applies to the liquid jet heads 56M, 56Y, and 56K.

An aspect in which the liquid jet head 56C disposed to be inclined with respect to a horizontal plane is raised and lowered along a direction parallel to a normal to the liquid jet surface 277C is exemplified in this embodiment. The liquid jet heads 56M, 56Y, and 56K are also raised and lowered along directions parallel to the directions of normals to the liquid jet surfaces 277M, 277Y, and 277K, respectively.

The liquid jet head 56C, which is shown by a two-dot chain line, represents the liquid jet head 56C moved to the retreat position. The same applies to the liquid jet heads 56M, 56Y, and 56K.

The retreat position of the liquid jet head 56C, the retreat position of the liquid jet head 56M, the retreat position of the liquid jet head 56Y, and the retreat position of the liquid jet head 56K shown in FIG. 9 are exemplary.

Oblique arrow lines shown in FIG. 9 indicate the moving directions of the liquid jet heads 56C, 56M, 56Y, and 56K. A curve with an arrow, which is shown in the drawing drum 52, indicates the rotation direction of the drawing drum 52.

The liquid jet heads 56C, 56M, 56Y, and 56K are individually operated so as to be raised and lowered by the head raising/lowering units 400 shown in FIGS. 6 and 7.

The movement parameter setting unit 142 shown in FIG. 8 can individually set movement parameters for the liquid jet heads 56C, 56M, 56Y, and 56K shown in FIG. 9.

Reference numeral 57C shown in FIG. 9 denotes the jet region of the liquid jet head 56C. Reference numeral 57M denotes the jet region of the liquid jet head 56M. Reference numeral 57Y denotes the jet region of the liquid jet head 56Y. Reference numeral 57K denotes the jet region of the liquid jet head 56K.

Reference numeral 52C shown in FIG. 9 denotes the gripper that grips a front end region 36B of a sheet 36. The front end region 36B of the sheet 36 is a region that has a predetermined length from the front end of the sheet 36 in the sheet transport direction. A length, which allows a sheet to be gripped by the gripper 52C, can be applied as the predetermined distance.

Reference numeral 52D denotes the recessed portion which is formed on the outer peripheral surface 52B of the drawing drum 52 and in which the gripper 52C is disposed.

The liquid jet head 56C shown in FIG. 9 is one aspect of the first liquid jet head. In a case where the liquid jet head 56C is the first liquid jet head, at least one of the liquid jet head 56M, 56Y, or 56K can be the second liquid jet head.

In a case where the liquid jet head 56C is the first liquid jet head, the jet position of the liquid jet head 56C is a first jet position. Further, the retreat position of the liquid jet head 56C is a first retreat position.

In a case where the liquid jet head 56C is the first liquid jet head, any one of the jet position of the liquid jet head 56M, the jet position of the liquid jet head 56Y, or the jet position of the liquid jet head 56K can be a second jet position. Further, the retreat position of the liquid jet head 56M, the retreat position of the liquid jet head 56Y, or the retreat position of the liquid jet head 56K can be a second retreat position.

In a case where the liquid jet head 56C is the first liquid jet head and the liquid jet head 56M is the second liquid jet head, the liquid jet head 56Y or 56K can be the third liquid jet head.

Further, the jet position of the liquid jet head 56Y or the jet position of the liquid jet head 56K can be a third jet position. The retreat position of the liquid jet head 56Y or the retreat position of the liquid jet head 56K can be a third retreat position.

The liquid jet head 56M is one aspect of the first liquid jet head. In a case where the liquid jet head 56M is the first liquid jet head, any one of the liquid jet head 56Y or 56K can be the second liquid jet head.

In a case where the liquid jet head 56M is the first liquid jet head, the jet position of the liquid jet head 56M is the first jet position. Further, the retreat position of the liquid jet head 56M is the first retreat position.

In a case where the liquid jet head 56M is the first liquid jet head, any one of the jet position of the liquid jet head 56Y or the jet position of the liquid jet head 56K can be the second jet position. Further, any one of the retreat position of the liquid jet head 56Y or the retreat position of the liquid jet head 56K can be the second retreat position.

In a case where the liquid jet head 56M is the first liquid jet head and the liquid jet head 56Y is the second liquid jet head, the liquid jet head 56K is the third liquid jet head. Further, the jet position of the liquid jet head 56K is the third jet position. The retreat position of the liquid jet head 56K is the third retreat position.

The liquid jet head 56Y is one aspect of the first liquid jet head. In a case where the liquid jet head 56Y is the first liquid jet head, the liquid jet head 56K is the second liquid jet head. In a case where the liquid jet head 56Y is the first liquid jet head, the jet position of the liquid jet head 56Y is the first jet position. Further, the retreat position of the liquid jet head 56Y is the first retreat position.

In a case where the liquid jet head 56Y is the first liquid jet head, the jet position of the liquid jet head 56K is the second jet position. Further, the retreat position of the liquid jet head 56K is the second retreat position.

Figure 10:
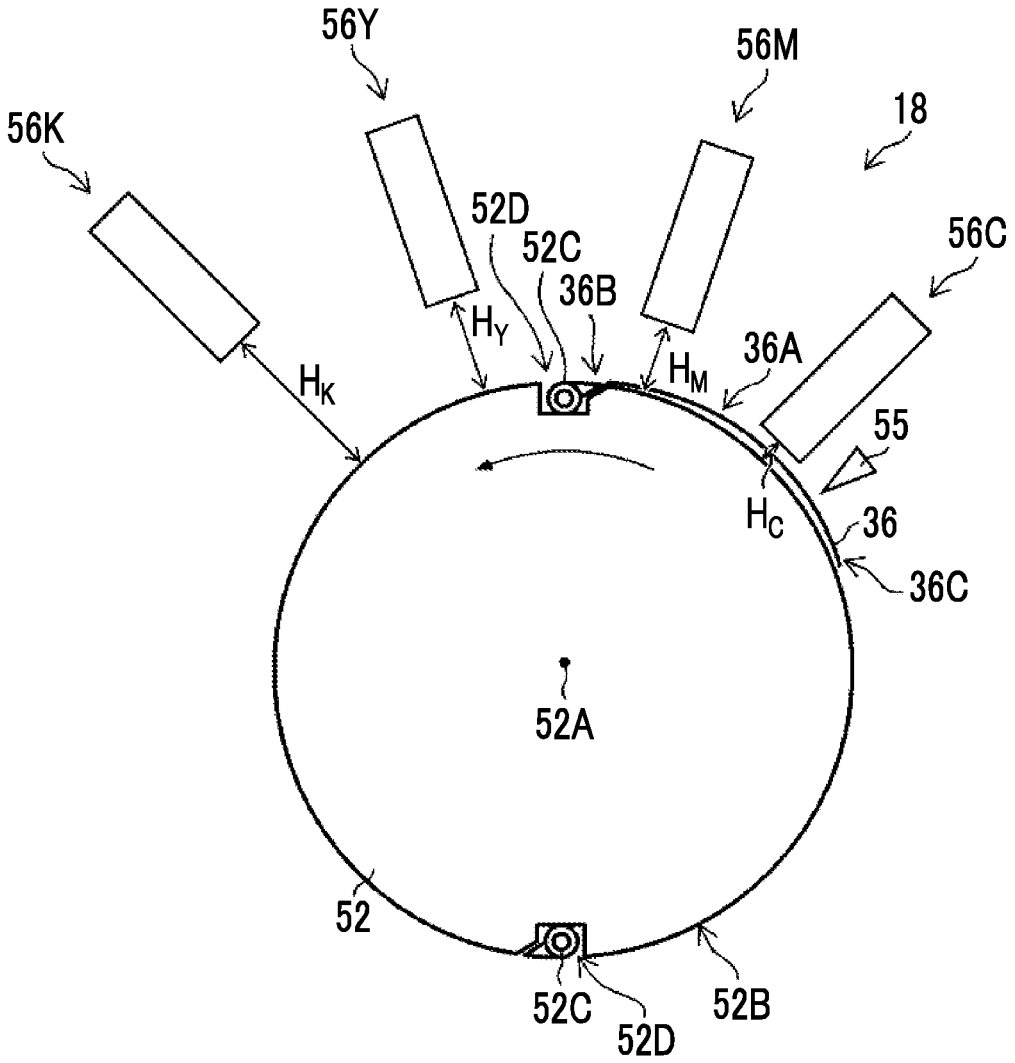
FIG. 10 is a diagram showing a method of coping with the floating of a sheet according to a first embodiment.
Figure 11:
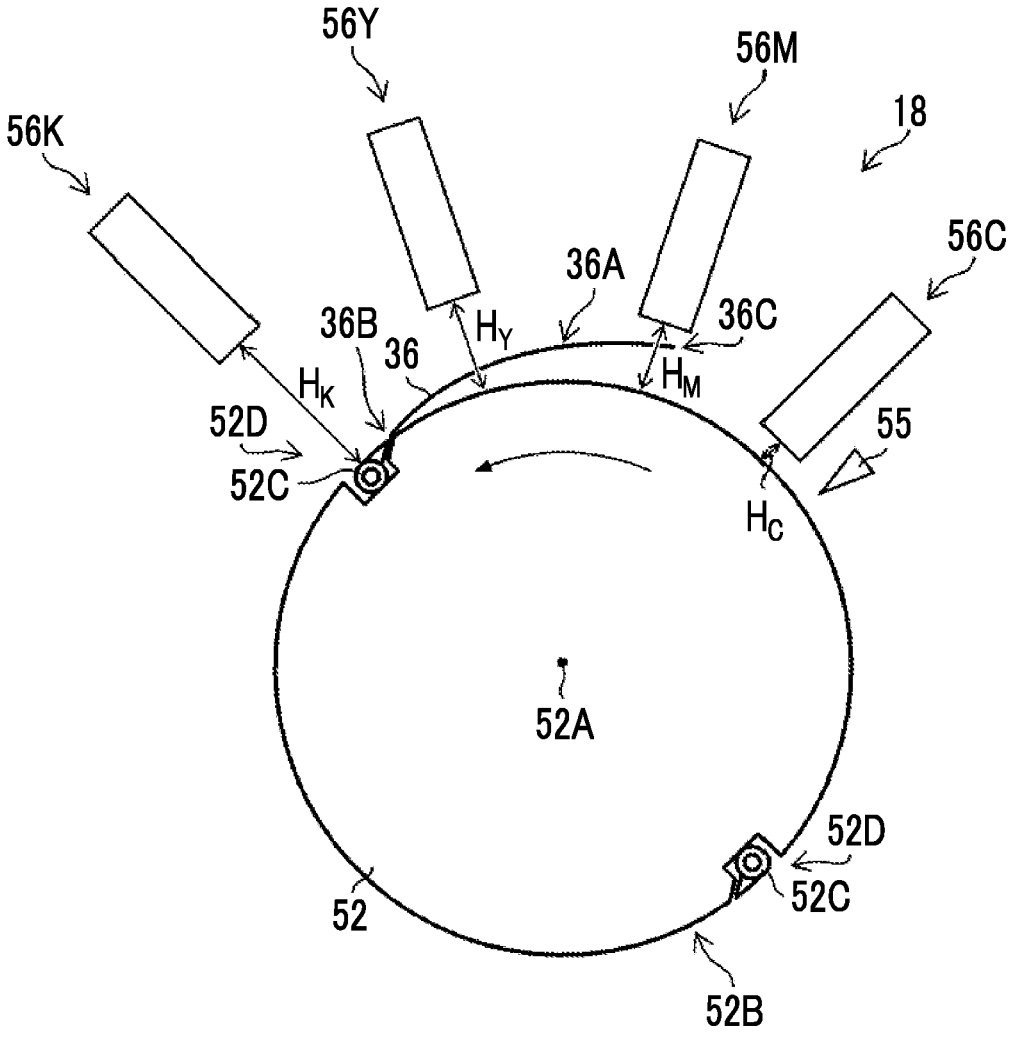
FIG. 11 is a diagram showing the method of coping with the floating of a sheet according to the first embodiment.

FIGS. 10 to 13 are diagrams showing a method of coping with the floating of a sheet according to a first embodiment. FIG. 10 is a diagram schematically showing a state where a portion of a sheet 36 on which the floating occurs passes through the jet region 57C of the liquid jet head 56C. FIG. 11 is a diagram schematically showing a state where a portion of a sheet 36 on which the floating occurs passes through the jet region 57M of the liquid jet head 56M.

Figure 12:
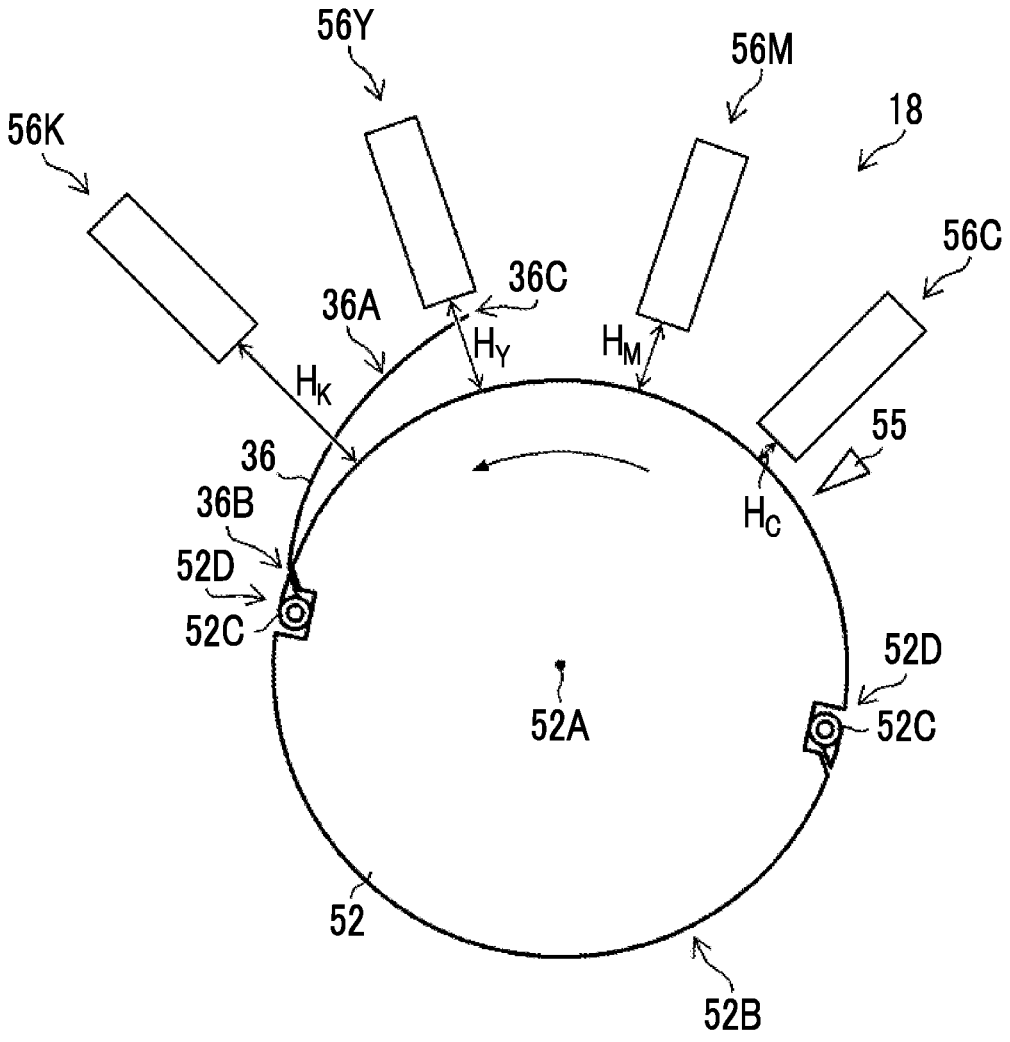
FIG. 12 is a diagram showing the method of coping with the floating of a sheet according to the first embodiment.
Figure 13:
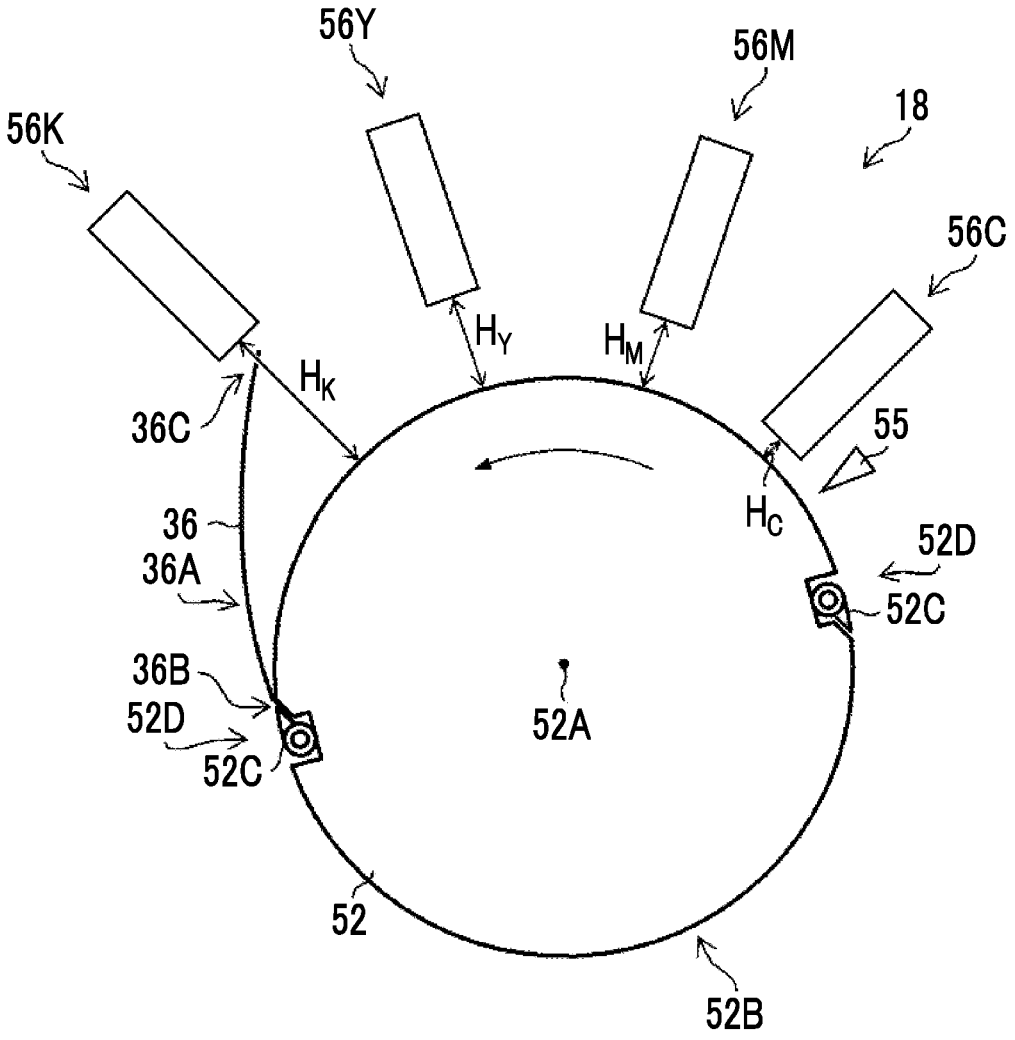
FIG. 13 is a diagram showing the method of coping with the floating of a sheet according to the first embodiment.

FIG. 12 is a diagram schematically showing a state where a portion of a sheet 36 on which the floating occurs passes through the jet region 57Y of the liquid jet head 56Y. FIG. 13 is a diagram schematically showing a state where a portion of a sheet 36 on which the floating occurs passes through the jet region 57K of the liquid jet head 56K.

In the method of coping with the floating of a sheet according to the first embodiment, the moving distance of the liquid jet head positioned on the downstream side in the sheet transport direction in the drawing unit 18 exceeds the moving distance of the liquid jet head positioned on the upstream side in the sheet transport direction in the drawing unit 18.

That is, in a case where the moving distance of the liquid jet head 56C shown in FIGS. 10 to 13 is denoted by $H_C$, the moving distance of the liquid jet head 56M is denoted by $H_M$, the moving distance of the liquid jet head 56Y is denoted by $H_Y$, and the moving distance of the liquid jet head 56K is denoted by $H_K$, a relationship between the moving distance $H_C$ of the liquid jet head 56C, the moving distance $H_M$ of the liquid jet head 56M, the moving distance $H_Y$ of the liquid jet head 56Y, and the moving distance $H_K$ of the liquid jet head 56K is represented by Equation 1 to be described below.

$$H_C<H_M<H_Y<H_K \quad \text{Equation 1}$$

supported on the outer peripheral surface 52B of the drawing drum 52. The centrifugal force F acting on the sheet 36 is a force that is applied in a direction where the sheet 36 is separated from the outer peripheral surface 52B of the drawing drum 52.

In a case where floating occurs on the sheet 36, the third term r+dh of the right-hand side of Equation 2 is increased and the centrifugal force F proportional to "r+dh" is also increased. An increase in the floating of the sheet 36 and an increase in the centrifugal force F acting on the sheet 36 are repeated in this way. Accordingly, the floating distance of the sheet 36 in the jet region of the liquid jet head, which is disposed at a position on the downstream side in the sheet transport direction, can exceed the floating distance of the sheet 36 in the jet region of the liquid jet head that is disposed at a position on the upstream side in the sheet transport direction.

An example of the floating distance of the sheet 36 and an example of the centrifugal force at each of the jet position of the liquid jet head 56C, the jet position of the liquid jet head 56M, the jet position of the liquid jet head 56Y, and the jet position of the liquid jet head 56K shown in FIGS. 10 to 13 are shown in Table 1 to be described below.

TABLE 1

| | 55 | 56C | 56M | 56Y | 56K |
|---|---|---|---|---|---|
| Distance from sheet floating-detection sensor [mm] | 0 | 62 | 124 | 186 | 248 |
| Floating distance of sheet [mm] | 0.50 | 9.06 | 17.95 | 27.17 | 36.74 |
| Centrifugal force [g · mm/s$^2$] | 2948.2 | 3060.1 | 3176.3 | 3296.9 | 3422.1 |
| Centrifugal force [N] | $2.948 \times 10^{-3}$ | $3.060 \times 10^{-3}$ | $3.176 \times 10^{-3}$ | $3.297 \times 10^{-3}$ | $3.422 \times 10^{-3}$ |
| Time having passed from timing when sheet has passed through the previous head (sensor) [s] | — | 0.0585 | 0.0585 | 0.0585 | 0.0585 |

The reason for this is as follows. In a case where a sheet 36 is transported along the outer peripheral surface 52B of the drawing drum 52 while the sheet 36 is sucked and supported on the outer peripheral surface 52B of the drawing drum 52, floating can occur at a rear end region 36C of the sheet 36.

Then, there is the mode of the floating of a sheet where the floating of the rear end region 36C of the sheet 36 is increased due to the rotation of the drawing drum 52 as the sheet 36 is transported to the downstream side in the sheet transport direction.

In a case where the mass of the floating region of the sheet 36 is denoted by m, the angular speed of the drawing drum 52 is denoted by co, the radius of the drawing drum 52 is denoted by r, and the floating distance of the sheet 36 is denoted by dh, a centrifugal force F acting on the sheet 36 is represented by Equation 2 to be described below. The mass m of the sheet 36 has a fixed value corresponding to the kind of the sheet 36. The angular speed w of the drawing drum 52 has a fixed value corresponding to the rotational speed of the drawing drum 52.

$$F=m\times\omega^2\times(r+dh) \quad \text{Equation 2}$$

The centrifugal force F caused by the rotation of the drawing drum 52 acts on the sheet 36 that is sucked and Reference numeral 55 of in Table 1 represents the sheet floating-detection sensor 55 shown in FIGS. 10 to 13. Reference numeral 56C of Table 1 represents the liquid jet head 56C shown in FIGS. 10 to 13.

Reference numeral 56M of Table 1 represents the liquid jet head 56M shown in FIGS. 10 to 13. Reference numeral 56Y of Table 1 represents the liquid jet head 56Y shown in FIGS. 10 to 13. Reference numeral 56K of Table 1 represents the liquid jet head 56K shown in FIGS. 10 to 13.

Parameters, which are used for the calculation of the floating distance of each liquid jet head of Table 1, are as follows. The magnitude of the rotational speed of the drawing drum 52 is 0.75 revolutions per second. In a case where the magnitude of the rotational speed of the drawing drum 52 is converted into the magnitude of the angular speed, the magnitude of the rotational speed of the drawing drum 52 is 4.71 radians per second. In a case where the radius of the drawing drum 52 is 225 mm, the magnitude of the speed of the outer peripheral surface of the drawing drum 52 is 1060.3 mm/sec.

In a case where it is assumed that a region having a length of 5 mm from the rear end of a sheet 36 having a length of 750 mm in the width direction floats, the mass of the floating region of the sheet 36 was calculated. The mass of the floating region of the sheet 36 was 0.59 g as a constant. The mass of the floating region of the sheet 36 can be calculated according to parameters of the sheet 36, such as the kind and thickness of the sheet 36.

The floating distance of the sheet 36, which is detected by the sheet floating-detection sensor 55 shown in FIG. 10, is 0.5 mm. The floating distance of the sheet 36 at the position of each liquid jet head in Table 1 was calculated using a function that uses a centrifugal force of the items of one liquid jet head positioned on the upstream side in the sheet transport direction and a distance from one liquid jet head positioned on the upstream side in the sheet transport direction as parameters. In the case of the liquid jet head 56C, the items of one liquid jet head positioned on the upstream side in the sheet transport direction are the items of the sheet floating-detection sensor 55. The items of one liquid jet head positioned on the upstream side in the sheet transport direction are the items of the left column of Table 1.

For example, the floating distance of the sheet 36 at the position of the liquid jet head 56M is calculated using a function that uses a centrifugal force acting on the sheet 36 at the position of the liquid jet head 56C and a distance between the liquid jet heads 56C and 56M as parameters. The same applies to the liquid jet heads 56Y and 56K.

Figure 14:
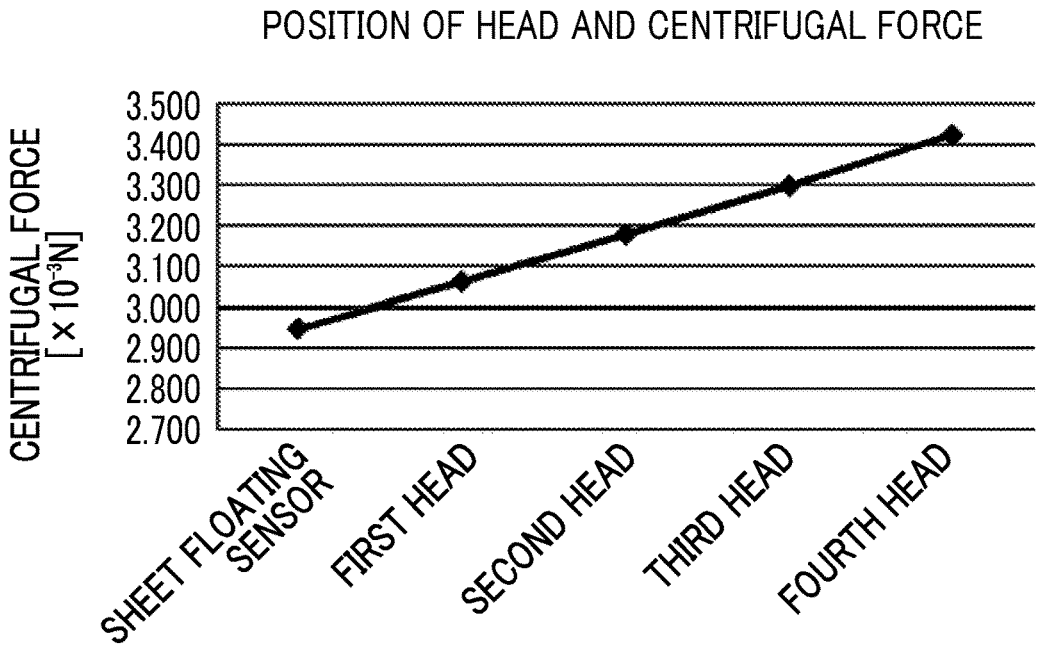
FIG. 14 is a graph showing a relationship between the position of each liquid jet head on a sheet transport path and a centrifugal force at the position of each liquid jet head.

FIG. 14 is a graph showing a relationship between the position of each liquid jet head on the sheet transport path and a centrifugal force at the position of each liquid jet head. As shown in FIG. 14, a centrifugal force acting on the sheet 36 is increased as the sheet 36 is transported to the downstream side in the sheet transport direction.

Further, a relationship between the position of each liquid jet head on the sheet transport path and a centrifugal force at the position of each liquid jet head is linear in a case where the respective liquid jet heads are arranged at regular intervals. On the other hand, a relationship between the position of each liquid jet head on the sheet transport path and a centrifugal force at the position of each liquid jet head is non-linear in a case where the respective liquid jet heads are not arranged at regular intervals.

Figure 15:
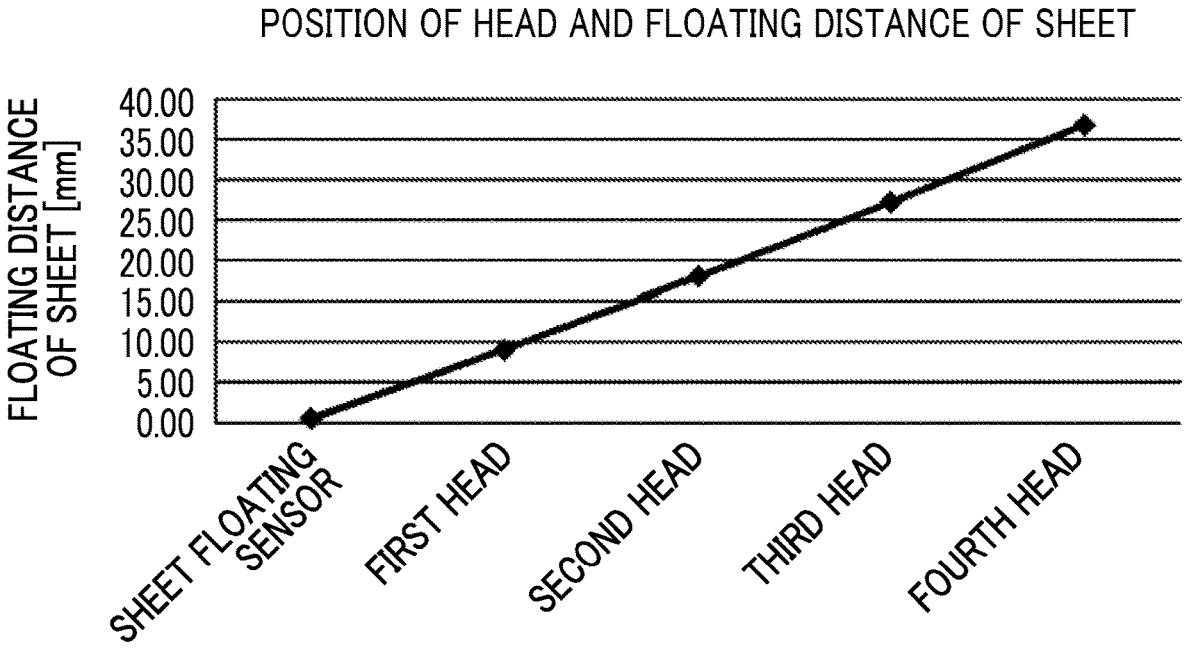
FIG. 15 is a graph showing a relationship between the position of each liquid jet head on the sheet transport path and the floating distance of a sheet at the position of each liquid jet head.

FIG. 15 is a graph showing a relationship between the position of each liquid jet head on the sheet transport path and the floating distance of a sheet at the position of each liquid jet head. As in the case of a centrifugal force acting on the sheet 36, the floating distance of the sheet 36 is increased as the sheet 36 is transported to the downstream side in the sheet transport direction.

Further, a relationship between the position of each liquid jet head on the sheet transport path and the floating distance of a sheet at the position of each liquid jet head is linear in a case where the respective liquid jet heads are arranged at regular intervals. On the other hand, a relationship between the position of each liquid jet head on the sheet transport path and the floating distance of a sheet at the position of each liquid jet head is non-linear in a case where the respective liquid jet heads are not arranged at regular intervals.

[Description of Flow of Procedure of Method of Coping with Floating of Sheet]

Figure 16:
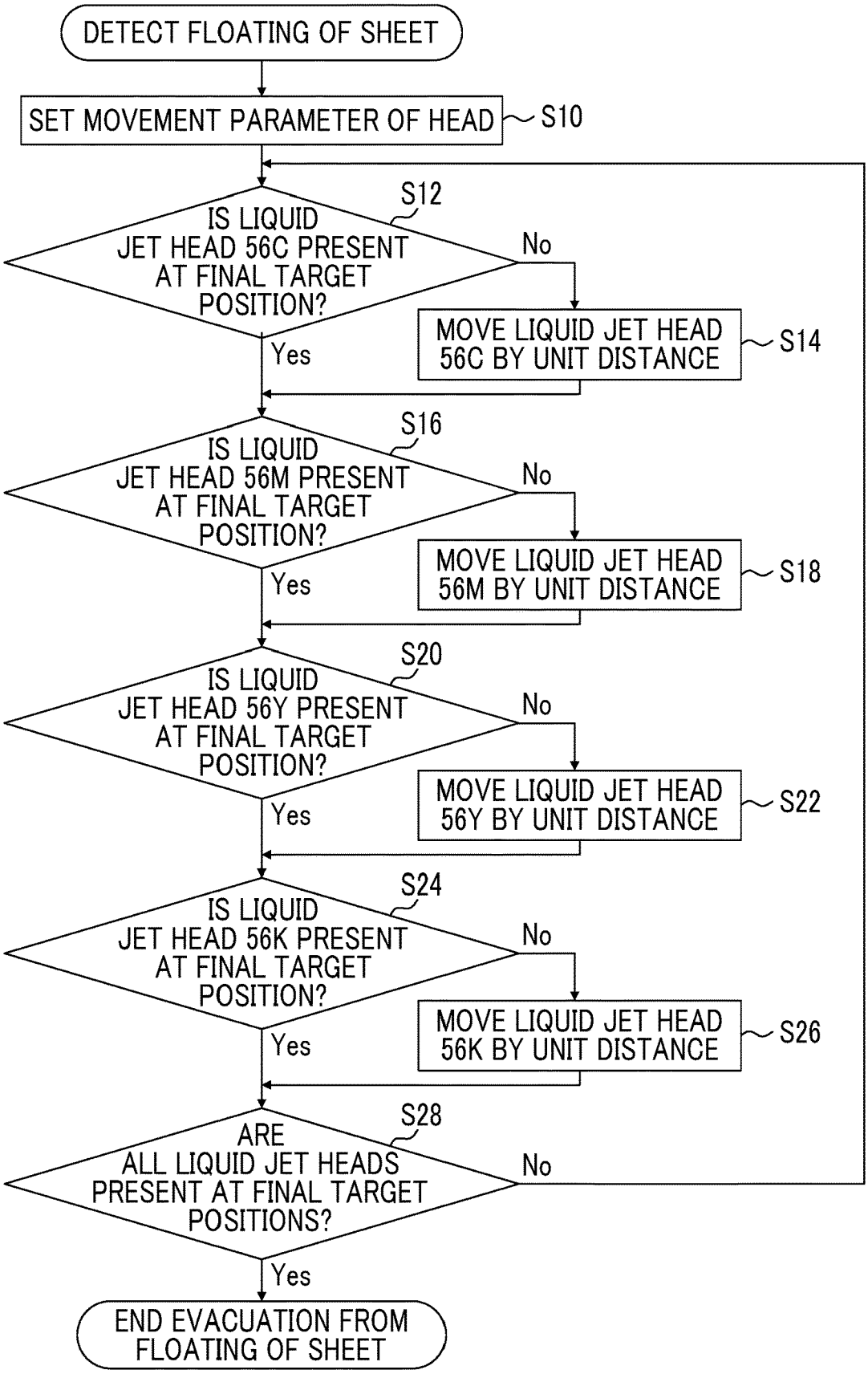
FIG. 16 is a flowchart showing the flow of a procedure of the method of coping with the floating of a sheet according to the first embodiment.

FIG. 16 is a flowchart showing the flow of a procedure of the method of coping with the floating of a sheet according to the first embodiment. The method of coping with the floating of a sheet shown in FIG. 16 is performed in a case where the floating of the sheet 36 is detected by the sheet floating-detection sensor 55 shown in FIGS. 10 to 13.

The method of coping with the floating of a sheet of which the procedure will be described below moves the liquid jet heads 56C, 56M, 56Y, and 56K to the retreat positions from the jet position without stopping the operation of the drawing drum 52 in a case where the floating of the sheet 36 shown in FIGS. 10 to 13 is detected. The jet of liquid from the liquid jet heads 56C, 56M, 56Y, and 56K is stopped in a case where the floating of the sheet 36 is detected.

The system controller 100 shown in FIG. 8 activates a sheet floating coping program in which the procedure of the method of coping with the floating of a sheet is prescribed, and executes the sheet floating coping program.

First, the floating of the sheet 36 shown in FIGS. 10 to 13 is detected in a sheet floating detection step. A movement parameter-setting step S10 is performed after the sheet floating detection step. The sheet floating detection step is one aspect of a medium floating detection step.

In the movement parameter-setting step S10, the movement parameter setting unit 142 shown in FIG. 8 individually sets movement parameters for the respective liquid jet heads 56C, 56M, 56Y, and 56K shown in FIGS. 10 to 13.

The movement parameters include the moving distances of the respective liquid jet heads 56C, 56M, 56Y, and 56K shown in FIGS. 10 to 13.

The movement parameter setting unit 142 shown in FIG. 8 calculates values, which are obtained by adding predetermined margins to the floating distances of the sheet 36 at the positions of the respective liquid jet heads 56C, 56M, 56Y, and 56K, as the moving distances of the respective liquid jet heads 56C, 56M, 56Y, and 56K shown in FIGS. 10 to 13.

The kind of the sheet 36, the floating distance of the sheet 36, the transport speed of the sheet 36, and the like can be used as parameters to determine each of the margins. The margins may be derived from experiments, or may be derived from simulations. The margins correspond to predetermined distances to be added to the floating distances of a medium.

The movement parameters may include the moving speeds of the respective liquid jet heads 56C, 56M, 56Y, and 56K. The moving speeds of the respective liquid jet heads 56C, 56M, 56Y, and 56K may have fixed values.

The moving speeds of the respective liquid jet heads 56C, 56M, 56Y, and 56K may be calculated using a transport parameter, such as the transport speed of the sheet 36. The moving speeds of the respective liquid jet heads 56C, 56M, 56Y, and 56K may be individually set.

In the movement parameter-setting step S10 of FIG. 16, processing proceeds to a first head position-determination step S12 of FIG. 16 after the movement parameter setting unit 142 shown in FIG. 8 sets the movement parameters of the respective liquid jet heads 56C, 56M, 56Y, and 56K shown in FIGS. 10 to 13.

The movement parameter-setting step S10 of FIG. 16 includes a first movement parameter-setting step and a second movement parameter-setting step. The movement parameter-setting step S10 may be divided into the first movement parameter-setting step and the second movement parameter-setting step.

In the first head position-determination step S12, the head raising/lowering control unit 120 shown in FIG. 8 determines whether or not the liquid jet head 56C shown in FIG. 10 is positioned at a final target position. Examples of the final target position mentioned here include the position of the liquid jet head 56C shown in FIG. 10.

If the head raising/lowering control unit 120 shown in FIG. 8 determines that the liquid jet head 56C shown in FIGS. 10 to 13 is not positioned at the final target position, the determination of No is made in the first head position-determination step S12 of FIG. 16. If the determination of No is made, processing proceeds to a first head moving step S14 of FIG. 16.

In the first head moving step S14, the head raising/lowering control unit 120 shown in FIG. 8 uses the head raising/lowering unit 400 to move the liquid jet head 56C shown in FIGS. 10 to 13 in a unit period by a unit distance.

The unit period is a predetermined period, and is a period that is sufficiently shorter than a period where the liquid jet head is moved to the retreat position from the jet position. The unit period is set according to the processing capacities of the system controller 100 and the head raising/lowering control unit 120 shown in FIG. 8.

The unit distance is a distance that is sufficiently shorter than a distance between the jet position and the retreat position of the liquid jet head, and is a distance by which the liquid jet head is moved in the unit period. The unit distance is determined according to the unit period and the moving speed of the liquid jet head.

Time-sharing control, which performs the movement of the liquid jet head in the unit period by the unit distance one or more times to move the liquid jet head to the retreat position from the jet position, is applied in this embodiment. That is, the liquid jet heads 56M, 56Y, and 56K are stopped in a period where the liquid jet head 56C shown in FIGS. 10 to 13 is moved.

Further, the liquid jet heads 56C, 56Y, and 56K are stopped in a period where the liquid jet head 56M is moved. The same applies to a period where the liquid jet head 56C is moved and a period where the liquid jet head 56K is moved.

Since time-sharing control is applied, the operations of a plurality of liquid jet heads can be controlled by one control unit. In this embodiment, the operations of four liquid jet heads are controlled by one control unit.

In terms of improving control responsiveness, it is preferable that the value of the unit period is as small as possible. It is preferable that the unit period is 1/100 or less of a period where the liquid jet head 56C positioned on the most upstream side in the sheet transport direction is moved to the retreat position from the jet position.

After the head raising/lowering control unit 120 shown in FIG. 8 uses the head raising/lowering unit 400 to move the liquid jet head 56C shown in FIGS. 10 to 13 by a unit distance in the first head moving step S14 of FIG. 16, processing proceeds to a second head position-determination step S16 of FIG. 16.

On the other hand, if the head raising/lowering control unit 120 shown in FIG. 8 determines that the liquid jet head 56C shown in FIGS. 10 to 13 is positioned at the final target position, the determination of Yes is made in the first head position-determination step S12. If the determination of Yes is made, processing proceeds to the second head position-determination step S16 of FIG. 16.

In the second head position-determination step S16, the head raising/lowering control unit 120 shown in FIG. 8 determines whether or not the liquid jet head 56M shown in FIGS. 10 to 13 is positioned at a final target position. If the head raising/lowering control unit 120 shown in FIG. 8 determines that the liquid jet head 56M shown in FIGS. 10 to 13 is not positioned at the final target position, the determination of No is made in the second head position-determination step S16 of FIG. 16. If the determination of No is made, processing proceeds to a second head moving step S18 of FIG. 16.

In the second head moving step S18, the head raising/lowering control unit 120 shown in FIG. 8 uses the head raising/lowering unit 400 to move the liquid jet head 56M shown in FIGS. 10 to 13 in a unit period by a unit distance.

It is preferable that the unit period in the second head moving step S18 of FIG. 16 is the same as the unit period in the first head moving step S14. It is preferable that the unit distance in the second head moving step S18 is the same as the unit distance in the first head moving step S14.

After the head raising/lowering control unit 120 shown in FIG. 8 uses the head raising/lowering unit 400 to move the liquid jet head 56M shown in FIGS. 10 to 13 by a unit distance in the second head moving step S18 of FIG. 16, processing proceeds to a third head position-determination step S20 of FIG. 16.

On the other hand, if the head raising/lowering control unit 120 shown in FIG. 8 determines that the liquid jet head 56M shown in FIGS. 10 to 13 is positioned at the final target position, the determination of Yes is made in the second head position-determination step S16. If the determination of Yes is made, processing proceeds to the third head position-determination step S20 of FIG. 16.

In the third head position-determination step S20, the head raising/lowering control unit 120 shown in FIG. 8 determines whether or not the liquid jet head 56Y shown in FIGS. 10 to 13 is positioned at a final target position.

If the head raising/lowering control unit 120 shown in FIG. 8 determines that the liquid jet head 56Y shown in FIGS. 10 to 13 is not positioned at the final target position, the determination of No is made in the third head position-determination step S20 of FIG. 16. If the determination of No is made, processing proceeds to a third head moving step S22 of FIG. 16.

In the third head moving step S22, the head raising/lowering control unit 120 shown in FIG. 8 uses the head raising/lowering unit 400 to move the liquid jet head 56Y shown in FIGS. 10 to 13 in a unit period by a unit distance.

It is preferable that the unit period in the third head moving step S22 of FIG. 16 is the same as the unit period in the first head moving step S14. It is preferable that the unit distance in the third head moving step S22 is the same as the unit distance in the first head moving step S14.

After the head raising/lowering control unit 120 shown in FIG. 8 uses the head raising/lowering unit 400 to move the liquid jet head 56Y shown in FIGS. 10 to 13 by a unit distance in the third head moving step S22 of FIG. 16, processing proceeds to a fourth head position-determination step S24 of FIG. 16.

On the other hand, if the head raising/lowering control unit 120 shown in FIG. 8 determines that the liquid jet head 56Y shown in FIGS. 10 to 13 is positioned at the final target position, the determination of Yes is made in the third head position-determination step S20. If the determination of Yes is made, processing proceeds to the fourth head position-determination step S24 of FIG. 16.

In the fourth head position-determination step S24, the head raising/lowering control unit 120 shown in FIG. 8 determines whether or not the liquid jet head 56K shown in FIGS. 10 to 13 is positioned at a final target position.

If the head raising/lowering control unit 120 shown in FIG. 8 determines that the liquid jet head 56K shown in FIGS. 10 to 13 is not positioned at the final target position, the determination of No is made in the fourth head position-determination step S24 of FIG. 16. If the determination of No is made, processing proceeds to a fourth head moving step S26 of FIG. 16.

In the fourth head moving step S26, the head raising/lowering control unit 120 shown in FIG. 8 uses the head raising/lowering unit 400 to move the liquid jet head 56K shown in FIGS. 10 to 13 in a unit period by a unit distance.

It is preferable that the unit period in the fourth head moving step S26 of FIG. 16 is the same as the unit period in the first head moving step S14. It is preferable that the unit distance in the fourth head moving step S26 is the same as the unit distance in the first head moving step S14.

After the head raising/lowering control unit 120 shown in FIG. 8 uses the head raising/lowering unit 400 to move the liquid jet head 56K shown in FIGS. 10 to 13 by a unit distance in the fourth head moving step S26 of FIG. 16, processing proceeds to an all head position-determination step S28 of FIG. 16.

On the other hand, if the head raising/lowering control unit 120 shown in FIG. 8 determines that the liquid jet head 56K shown in FIG. 10 is positioned at the final target position, the determination of Yes is made in the fourth head position-determination step S24. If the determination of Yes is made, processing proceeds to the all head position-determination step S28 of FIG. 16.

In the all head position-determination step S28, the head raising/lowering control unit 120 shown in FIG. 8 determines whether or not the liquid jet heads 56C, 56M, 56Y, and 56K shown in FIGS. 10 to 13 reach retreat positions.

If the head raising/lowering control unit 120 shown in FIG. 8 determines that the liquid jet heads 56C, 56M, 56Y, and 56K shown in FIGS. 10 to 13 do not reach the retreat positions, the determination of No is made in the all head position-determination step S28 of FIG. 16. If the determination of No is made, processing proceeds to the first head position-determination step S12 of FIG. 16.

Then, the first head position-determination step S12 to the fourth head moving step S26 are repeatedly performed until the determination of Yes is made in the all head position-determination step S28.

On the other hand, if the head raising/lowering control unit 120 shown in FIG. 8 determines that the liquid jet heads 56C, 56M, 56Y, and 56K shown in FIGS. 10 to 13 reach the retreat positions, the determination of Yes is made in the all head position-determination step S28. If the determination of Yes is made, the head raising/lowering control unit 120 shown in FIG. 8 ends the method of coping with the floating of a sheet after performing end processing.

An aspect in which time-sharing control is applied to the movement of each liquid jet head has been exemplified in the method of coping with the floating of a sheet described in this embodiment. On the other hand, control units of which the number is the same as the number of liquid jet heads can be used to operate the plurality of liquid jet heads in the same period. That is, the head raising/lowering control unit 120 shown in FIG. 8 may allow the liquid jet heads 56C, 56M, 56Y, and 56K shown in FIGS. 10 to 13 to be operated while sharing time, or may allow the liquid jet heads 56C, 56M, 56Y, and 56K shown in FIGS. 10 to 13 to be operated in parallel in the same period.

Retreat operations shown in FIG. 13 are performed, and the return operations of the liquid jet heads 56C, 56M, 56Y, and 56K shown in FIGS. 10 to 13 are performed after a sheet 36 of which the floating is detected passes through the jet region 57C of the liquid jet head 56C, the jet region 57M of the liquid jet head 56M, the jet region 57Y of the liquid jet head 56Y, and the jet region 57K of the liquid jet head 56K shown in FIGS. 10 to 13.

The return operation of the liquid jet head 56C shown in FIGS. 10 to 13 may be performed when the sheet 36 of which the floating is detected has passed through the jet region 57C of the liquid jet head 56C and does not yet pass through the jet region 57M of the liquid jet head 56M.

The return operation of the liquid jet head 56C shown in FIGS. 10 to 13 may be performed when the sheet 36 of which the floating is detected has passed through any one of the jet region 57M of the liquid jet head 56M, the jet region 57Y of the liquid jet head 56Y, or the jet region 57C of the liquid jet head 56K.

The same applies to the liquid jet heads 56M, 56Y, and 56K shown in FIGS. 10 to 13.

Effects of First Embodiment

According to the ink jet recording apparatus and the method of coping with the floating of a sheet of the first embodiment, when the retreat operations of liquid jet heads are to be performed in a case where the floating of a sheet occurs, moving distances are individually set for the respective liquid jet heads on the basis of the floating distances of the sheet at the jet positions of the respective liquid jet heads.

Accordingly, since the moving distance of the liquid jet head having the maximum moving distance is not set as the moving distances of all the liquid jet heads in a case where the retreat operations of the respective liquid jet heads are to be performed, an increase in the size of the head raising/lowering unit for moving each liquid jet head can be avoided.

In an aspect in which a sheet is transported along the outer peripheral surface of the transport drum by the transport drum, the floating distance of the sheet at each of the liquid jet heads is calculated using a centrifugal force acting on the sheet at each of the jet positions of the liquid jet heads.

Since a centrifugal force acting on a sheet is increased as the sheet is transported to the downstream side in the transport direction, the moving distance of the liquid jet head disposed at a position on the downstream side in the sheet transport direction exceeds the moving distance of the liquid jet head disposed at a position on the upstream side.

Accordingly, even in a case where the floating distance of a sheet as the sheet is transported to the downstream side in the sheet transport direction, the collision between the liquid jet head and the sheet can be avoided. Further, since the moving distance of the liquid jet head disposed on the upstream side in the sheet transport direction can be set to be shorter than the moving distance of the liquid jet head disposed on the upstream side in the sheet transport direction, an increase in the size of the head raising/lowering unit for moving each liquid jet head can be avoided.

An aspect in which the head raising/lowering units 400 shown in FIG. 6 move the respective liquid jet heads 56C, 56M, 56Y, and 56K shown in FIGS. 10 to 13 in a direction inclined with respect to a direction opposite to the direction of gravity has been exemplified in this embodiment, but the head raising/lowering units 400 shown in FIG. 6 may move the respective liquid jet heads 56C, 56M, 56Y, and 56K shown in FIGS. 10 to 13 in a direction opposite to the direction of gravity and in the direction of gravity.

[Method of Coping with Floating of Sheet According to Second Embodiment]

Figure 17:
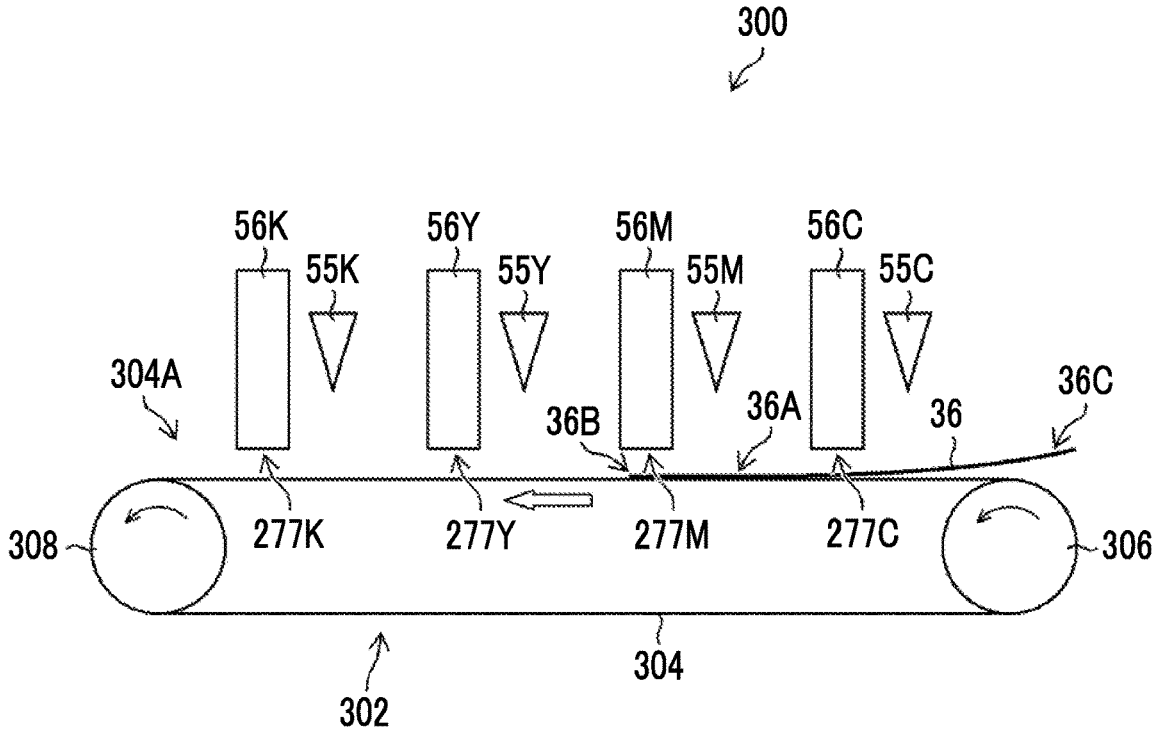
FIG. 17 is a diagram showing an example of the configuration of an ink jet recording apparatus according to a second embodiment.

Next, a method of coping with the floating of a sheet according to a second embodiment will be described. FIG. 17 is a diagram showing an example of the configuration of an ink jet recording apparatus according to the second embodiment. A belt transport system is employed in a transport unit 302 that is applied to the ink jet recording apparatus 300 according to the second embodiment.

The transport unit 302 shown in FIG. 17 comprises a transport belt 304, a first roller 306, and a second roller 308. The transport belt 304 is endless. The transport belt 304 is wound on the first and second rollers 306 and 308. Since the first roller 306 or the second roller 308 is rotated, the transport belt 304 travels.

An arrow line shown in FIG. 17 indicates the travel direction of the transport belt 304. The travel direction of the transport belt 304 is the transport direction of a sheet 36 that is supported by the transport belt 304. A curve with an arrow, which is shown in the first roller 306, indicates the rotation direction of the first roller 306. A curve with an arrow, which is shown in the second roller 308, indicates the rotation direction of the second roller 308.

A rotating shaft of a motor (not shown) is connected to the first roller 306. The first roller 306 is rotated due to the rotation of the rotating shaft of the motor. The transport belt 304 travels due to the rotation of the first roller 306 and the driven rotation of the second roller 308.

A plurality of suction holes are arranged on a sheet support surface 304A, which supports a sheet 36, of the transport belt 304. The plurality of suction holes are not shown. Examples of the arrangement of the plurality of suction holes include two-dimensional arrangement in the sheet transport direction and the sheet width direction.

The transport unit 302 is one aspect of the medium transport unit. The sheet support surface 304A is one aspect of the medium support surface. The transport belt 304 is one aspect of a planar medium transport member.

The plurality of suction holes are connected to a flow passage that is formed in the transport belt 304. The flow passage formed in the transport belt 304 is not shown. The flow passage formed in the transport belt 304 is connected to a suction pressure generating unit. The suction pressure generating device is not shown. Examples of the suction pressure generating device include a pump.

A liquid jet head 56C, a liquid jet head 56M, a liquid jet head 56Y, and a liquid jet head 56K shown in FIG. 17 are arranged along the sheet transport direction in this order from the upstream side in the sheet transport direction.

The liquid jet head 56C shown in FIG. 17 is disposed so that a liquid jet surface 277C is parallel to the sheet support surface 304A of the transport belt 304. The same applies to a liquid jet surface 277M of the liquid jet head 56M, a liquid jet surface 277Y of the liquid jet head 56Y, and a liquid jet surface 277K of the liquid jet head 56K.

The liquid jet heads 56C, 56M, 56Y, and 56K shown in FIG. 17 have the same structure as the liquid jet heads 56C, 56M, 56Y, and 56K shown in FIG. 1.

The liquid jet heads 56C, 56M, 56Y, and 56K shown in FIG. 17 are mounted on the head raising/lowering units 400 shown in FIGS. 6 to 8.

Moving distances for retreat operations in a case where the contact between the sheet 36 and the liquid jet heads caused by the floating of the sheet 36 is avoided are individually set for the liquid jet heads 56C, 56M, 56Y, and 56K shown in FIG. 17.

The ink jet recording apparatus 300 comprises a sheet floating-detection sensor 55C, a sheet floating-detection sensor 55M, a sheet floating-detection sensor 55Y, and a sheet floating-detection sensor 55K. The sheet floating-detection sensor 55C is disposed at a position on the upstream side of the liquid jet head 56C in the sheet transport direction. The sheet floating-detection sensor 55C detects the floating of the sheet 36 and the floating distance of the sheet 36 immediately before the sheet 36 enters the jet position of the liquid jet head 56C.

Examples of "immediately before" mentioned here include a case where a distance between the liquid jet head 56C and the sheet floating-detection sensor 55C is shorter than a distance between the liquid jet head 56C and the liquid jet head 56M. The same applies to the sheet floating-detection sensors 55M, 55Y, and 55K.

The distance between the liquid jet head 56C and the sheet floating-detection sensor 55C is determined from conditions, such as a processing speed in the detection of the floating of the sheet 36, the moving speed of the liquid jet head 56C at the time of a retreat operation, and the transport speed of the sheet 36.

The same applies to a distance between the liquid jet head 56M and the sheet floating-detection sensor 55M, a distance between the liquid jet head 56Y and the sheet floating-detection sensor 55Y, and a distance between the liquid jet head 56K and the sheet floating-detection sensor 55K to be described later.

The sheet floating-detection sensor 55M is disposed at a position on the downstream side of the liquid jet head 56C in the sheet transport direction and on the upstream side of the liquid jet head 56M in the sheet transport direction. The sheet floating-detection sensor 55M detects the floating of the sheet 36 and the floating distance of the sheet 36 immediately before the sheet 36 enters the jet position of the liquid jet head 56M.

The sheet floating-detection sensor 55Y is disposed at a position on the downstream side of the liquid jet head 56M in the sheet transport direction and on the upstream side of the liquid jet head 56Y in the sheet transport direction. The sheet floating-detection sensor 55Y detects the floating of the sheet 36 and the floating distance of the sheet 36 immediately before the sheet 36 enters the jet position of the liquid jet head 56Y.

The sheet floating-detection sensor 55K is disposed at a position on the downstream side of the liquid jet head 56Y in the sheet transport direction and on the upstream side of the liquid jet head 56K in the sheet transport direction. The sheet floating-detection sensor 55K detects the floating of the sheet 36 and the floating distance of the sheet 36 immediately before the sheet 36 enters the jet position of the liquid jet head 56K.

The sheet floating-detection sensors 55C, 55M, 55Y, and 55K are the components of the sheet floating detection unit 140 shown in FIG. 8. The sheet floating-detection sensor 55C outputs a detection signal that represents the result of the detection of the floating of the sheet 36.

The system controller 100 shown in FIG. 8 sends the output signal of the sheet floating-detection sensor 55C to the head raising/lowering control unit 120. The head raising/lowering control unit 120 uses the detection result of the sheet floating-detection sensor 55C shown in FIG. 17 to calculate the moving distance of the liquid jet head 56C at the time of a retreat operation.

Likewise, the head raising/lowering control unit 120 shown in FIG. 8 uses the detection result of the sheet floating-detection sensor 55M shown in FIG. 17 to calculate the moving distance of the liquid jet head 56M shown in FIG. 17 at the time of a retreat operation.

The head raising/lowering control unit 120 shown in FIG. 8 uses the detection result of the sheet floating-detection sensor 55Y to calculate the moving distance of the liquid jet head 56Y shown in FIG. 17 at the time of a retreat operation. The head raising/lowering control unit 120 shown in FIG. 8 uses the detection result of the sheet floating-detection sensor 55K to calculate the moving distance of the liquid jet head 56K shown in FIG. 17 at the time of a retreat operation.

The head raising/lowering units 400 shown in FIGS. 6 to 8 move the respective liquid jet heads 56C, 56M, 56Y, and 56K shown in FIG. 17 in a direction opposite to the direction of gravity and in the direction of gravity on the basis of the moving distances of the respective liquid jet heads 56C, 56M, 56Y, and 56K shown in FIG. 17 that are calculated using the head raising/lowering control unit 120 shown in FIG. 8.

The head raising/lowering units 400 shown in FIGS. 6 to 8 may move the liquid jet heads 56C, 56M, 56Y, and 56K shown in FIG. 17 in a direction that has a component corresponding to a direction opposite to the direction of gravity and in a direction that has a component corresponding to the direction of gravity.

The sheet floating-detection sensor 55C is one example of a component of the first medium floating detection unit. The sheet floating-detection sensors 55M, 55Y, and 55K can be one example of a component of a second medium floating detection unit.

The sheet floating-detection sensor 55M is one example of a component of the first medium floating detection unit. The sheet floating-detection sensors 55Y and 55K can be one example of a component of the second medium floating detection unit.

The sheet floating-detection sensor 55Y is one example of a component of the first medium floating detection unit. The sheet floating-detection sensor 55K can be one example of a component of the second medium floating detection unit.

Figure 18:
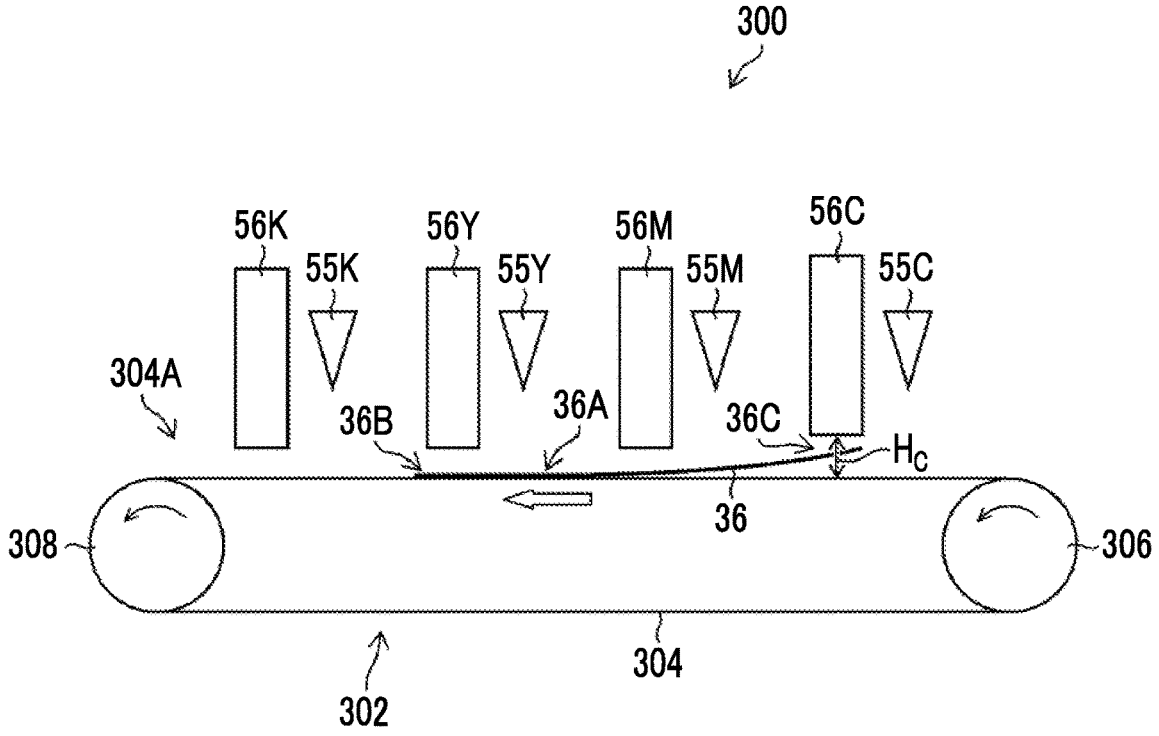
FIG. 18 is a schematic diagram showing a state where a first head is moved.

FIG. 18 is a schematic diagram showing a state where a first head is moved. In FIG. 18, the liquid jet head 56C serves as the first head. The first head may be a liquid jet head disposed so that at least one liquid jet head is disposed at a position on the downstream side thereof in the sheet transport direction.

Among the liquid jet heads 56C, 56M, 56Y, and 56K shown in FIG. 18, the liquid jet heads 56C, 56M, and 56Y can be the first head.

In a case where the sheet floating-detection sensor 55C detects the floating of the rear end region 36C of the sheet 36, the movement parameter setting unit 142 shown in FIG. 8 uses the head raising/lowering control unit 120 to set the moving distance $H_C$ of the liquid jet head 56C at the time of a retreat operation that is calculated on the basis of the floating distance of the sheet 36.

The head raising/lowering unit 400 shown in FIGS. 6 to 8 performs the retreat operation of the liquid jet head 56C on the basis of the moving distance $H_C$ of the liquid jet head 56C at the time of a retreat operation that is set by the movement parameter setting unit 142 shown in FIG. 8.

Figure 19:
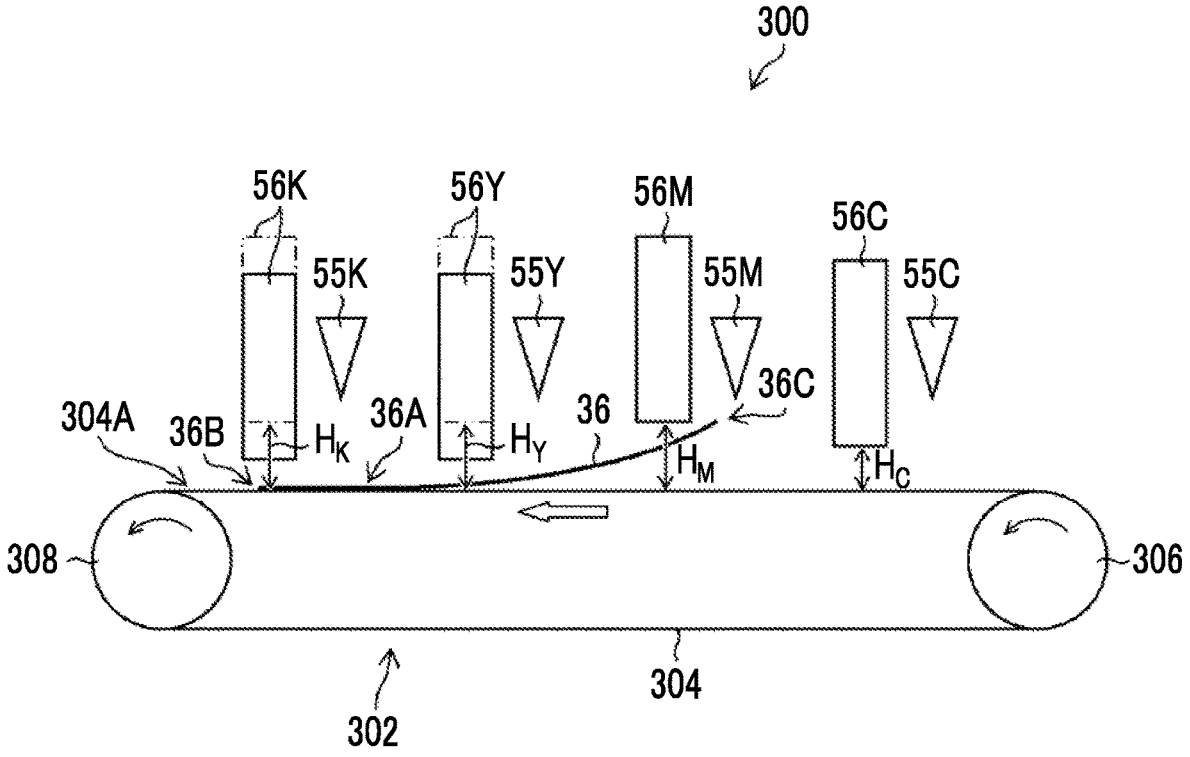
FIG. 19 is a schematic diagram showing a state where a second head is moved.

FIG. 19 is a schematic diagram showing a state where a second head is moved. In FIG. 19, the liquid jet head 56M serves as the second head. The liquid jet head 56C, which is disposed at a position on the upstream side of the liquid jet head 56M in the sheet transport direction, is the first head.

In a case where the sheet floating-detection sensor 55M detects the floating of the rear end region 36C of the sheet 36, the movement parameter setting unit 142 shown in FIG. 8 uses the head raising/lowering control unit 120 to set the moving distance $H_M$ of the liquid jet head 56M at the time of a retreat operation that is calculated on the basis of the floating distance of the sheet 36.

The head raising/lowering unit 400 shown in FIGS. 6 to 8 performs the retreat operation of the liquid jet head 56M on the basis of the moving distance $H_M$ of the liquid jet head 56M at the time of a retreat operation that is set by the movement parameter setting unit 142 shown in FIG. 8.

An example shown in FIG. 19 is a case where the floating distance of the sheet 36 detected by the sheet floating-detection sensor 55M is longer than the floating distance of the sheet 36 detected by the sheet floating-detection sensor 55C. In other words, the example shown in FIG. 19 is a case where the moving distance $H_M$ of the liquid jet head 56M at the time of a retreat operation exceeds the moving distance $H_C$ of the liquid jet head 56C at the time of a retreat operation.

In a case where the floating distance of the sheet 36 is increased as the sheet 36 is transported as described above, the moving distance $H_M$ of the liquid jet head 56M, which is disposed at a position on the downstream side in the sheet transport direction, at the time of a retreat operation is set to be longer than the moving distance $H_C$ of the liquid jet head 56C, which is disposed at a position on the upstream side in the sheet transport direction, at the time of a retreat operation.

Accordingly, even in a case where the floating distance of the sheet 36 is increased as the sheet 36 is transported, the contact between the sheet 36 and the liquid jet head 56C can be avoided and the contact between the sheet 36 and the liquid jet head 56M can be avoided.

In a case where the floating distance of the sheet 36 is reduced as the sheet 36 is transported, the moving distance $H_M$ of the liquid jet head 56M, which is disposed at a position on the downstream side in the sheet transport direction, at the time of a retreat operation may be set to be shorter than the moving distance $H_C$ of the liquid jet head 56C, which is disposed at a position on the upstream side in the sheet transport direction, at the time of a retreat operation.

Further, in a case where the floating distance of the sheet 36 is increased and reduced as the sheet 36 is transported, the moving distances of the respective liquid jet heads at the time of a retreat operation may be individually set according to the floating distances of the sheet 36 at the jet regions of the respective liquid jet heads.

The moving distance $H_Y$ of the liquid jet head 56Y shown in FIG. 19 at the time of a retreat operation can also be set in the same manner as the case of each of the liquid jet head 56C and the liquid jet head 56M. Further, the moving distance $H_K$ of the liquid jet head 56K at the time of a retreat operation can also be set in the same manner as the case of each of the liquid jet head 56C and the liquid jet head 56M. The liquid jet head 56Y, which is shown in FIG. 19 by a two-dot chain line, represents the liquid jet head 56Y corresponding to a random retreat position. The liquid jet head 56K, which is shown by a two-dot chain line, represents the liquid jet head 56K corresponding to a random retreat position.

The procedure shown in FIG. 16 can be applied to the method of coping with the floating of a sheet according to the second embodiment described with reference to FIGS. 17 to 19. The procedure of the method of coping with the floating of a sheet according to the second embodiment will be omitted.

Effects of Second Embodiment

According to the ink jet recording apparatus and the method of coping with the floating of a sheet of the second embodiment, the sheet floating-detection sensor is provided at a position on the upstream side of each liquid jet head in the sheet transport direction. The head raising/lowering control unit individually calculates the moving distances of the respective liquid jet heads at the time of a retreat operation according to the floating distances of a sheet that are detected by the respective sheet floating-detection sensors. The movement parameter setting unit individually sets the moving distances of the respective liquid jet heads at the time of a retreat operation. The head raising/lowering units perform the retreat operations of the respective liquid jet heads on the basis of the moving distances that are set for the respective liquid jet heads.

Accordingly, even in a case where the floating distance of a sheet is increased and reduced as the sheet is transported to the downstream side in the transport direction, the collision between each liquid jet head and the sheet can be avoided.

The transport of a paper medium has been exemplified in the first and second embodiments, but the invention can also be applied to the transport of a medium other than paper on which the floating may occur. Examples of the medium other than paper include mediums that are made of cloth, a resin, metal, and the like and have a thickness of 1 mm or less.

An ink jet recording apparatus has been exemplified as one example of the liquid jetting apparatus in the first and second embodiments. However, the liquid jetting apparatus is not limited to an ink jet recording apparatus for graphics, and can be widely applied to a pattern forming apparatus of an ink jet system that dyes a cloth medium, forms a pattern on a resin medium, and forms a pattern on a metal medium.

The embodiments of the invention described above can be properly subjected to the modification, addition, and deletion of components without departing from the scope of the invention. The invention is not limited to the above-mentioned embodiments, and can be modified in various ways by those skilled in the art without departing from the scope of the invention.

EXPLANATION OF REFERENCES

10: ink jet recording apparatus
12: sheet feed unit
14: treatment liquid-application section
16: treatment liquid-drying processing section
18: drawing unit
20: ink-drying processing section
21: drying processing device
22: sheet transport member
24: sheet discharge unit
30: stocker
32: sheet feed sensor
34: feeder board
36: sheet
36A: first surface
36B: front end region
36C: rear end region
42: treatment liquid drum
42A, 46A, 52A, 402C, 402D, 406A: rotating shaft
42B, 46B, 52B: outer peripheral surface
44: treatment liquid-application device
44A: application roller
44B: measurement roller
44C: treatment liquid container
46: treatment liquid-drying processing drum
48: transport guide
50: treatment liquid-drying processing device
52: drawing drum
52C: gripper
52D: recessed portion
55, 55C, 55M, 55Y, 55K: sheet floating-detection sensor
56, 56C, 56M, 56Y, 56K: liquid jet head
56A: one end
56B, 56E: bearing
56D: the other end
57C, 57M, 57Y, 57K: jet region
58: in-line sensor
100: system controller
102: communication unit
103: host computer
104: image memory
110: sheet feed control unit
112: transport control unit
114: transport unit
116: treatment liquid-application control unit
117: treatment liquid-drying processing control unit
118: drawing control unit
120: head raising/lowering control unit
122: ink-drying processing control unit
124: sheet discharge control unit
130: operation unit
132: display section
134: parameter storage unit
136: program storage unit
140: sheet floating detection unit
142: movement parameter setting unit
200: head module
210: flow passage structure
214: ink supply passage
216: individual supply passage
218: pressure chamber
220: nozzle communication passage
226: individual circulation flow passage
228: common circulation flow passage
230: piezoelectric element
231: piezoelectric layer
232: ink supply chamber
236: ink circulation chamber
252: supply-side individual flow passage
256: collection-side individual flow passage
264: upper electrode
265: lower electrode
266: vibrating plate
267: adhesive layer
275: nozzle plate
277, 277C, 277M, 277Y, 277K: liquid jet surface
280: nozzle opening
281: nozzle portion
300: ink jet recording apparatus
302: transport unit
304: transport belt
304A: sheet support surface
306: first roller
308: second roller
400: head raising/lowering unit
402A, 402B: eccentric cam
404: cam shaft
406: motor
410: motor driver
412: power source
$H_C$, $H_M$, $H_Y$, $H_K$: moving distance
S10 to S28: respective steps of method of coping with floating of sheet

What is claimed is:

1. A liquid jetting apparatus comprising:

a medium transport unit that includes a medium support surface supporting a sheet-like medium and transports the medium along a medium transport direction;

a first medium floating detection unit that detects floating of the medium transported by the medium transport unit;

a first liquid jet head that is disposed at a position on a downstream side of the first medium floating detection unit in the medium transport direction and jets liquid onto the medium transported by the medium transport unit;

a second liquid jet head that is disposed at a position on a downstream side of the first liquid jet head in the medium transport direction and jets liquid onto the medium transported by the medium transport unit;

a first head raising/lowering unit that moves the first liquid jet head in a direction having a component corresponding to a direction opposite to a direction of gravity or in a direction having a component corresponding to the direction of gravity;

a first movement parameter setting unit that sets a first movement parameter including a moving distance of the first liquid jet head moved by the first head raising/lowering unit;

a first head raising/lowering control unit that controls an operation of the first head raising/lowering unit using the first movement parameter set by the first movement parameter setting unit;

a second head raising/lowering unit that moves the second liquid jet head in the direction having the component corresponding to the direction opposite to the direction of gravity or in the direction having the component corresponding to the direction of gravity;

a second movement parameter setting unit that sets a second movement parameter including a moving distance of the second liquid jet head moved by the second head raising/lowering unit separately from the first movement parameter including the moving distance of the first liquid jet head set by the first movement parameter setting unit; and a second head raising/lowering control unit that controls an operation of the second head raising/lowering unit using the second movement parameter set by the second movement parameter setting unit, wherein the moving distance of the first liquid jet head is different moving distance of the second liquid jet head.

2. The liquid jetting apparatus according to claim 1, wherein the first head raising/lowering control unit uses the first head raising/lowering unit to raise and lower the first liquid jet head between a first jet position where liquid is jetted from the first liquid jet head and a first retreat position, which is away from the first jet position in a moving direction of the first liquid jet head by the moving distance of the first liquid jet head, on the basis of the first movement parameter set by the first movement parameter setting unit in a case where the floating of the medium is detected by the first medium floating detection unit, and the second head raising/lowering control unit uses the second head raising/lowering unit to raise and lower the second liquid jet head between a second jet position where liquid is jetted from the second liquid jet head and a second retreat position, which is away from the second jet position in a moving direction of the second liquid jet head by the moving distance of the second liquid jet head, on the basis of the second movement parameter set by the second movement parameter setting unit in a case where the floating of the medium is detected by the first medium floating detection unit.

3. The liquid jetting apparatus according to claim 1, wherein the first movement parameter setting unit sets the first movement parameter including a moving speed of the first liquid jet head moved by the first head raising/lowering unit, and the second movement parameter setting unit sets the second movement parameter including a moving speed of the second liquid jet head moved by the second head raising/lowering unit.

4. The liquid jetting apparatus according to claim 1, wherein the first medium floating detection unit detects a floating distance of the medium at a position of the first medium floating detection unit on a transport path of the medium, and the first movement parameter setting unit sets a distance between a position of the first liquid jet head and the position of the first medium floating detection unit on the transport path of the medium to be transported by the medium transport unit, a transport speed of the medium transported by the medium transport unit, and a moving distance of the first liquid jet head, which is calculated using the floating distance of the medium detected by the first medium floating detection unit, as the first movement parameter.

5. The liquid jetting apparatus according to claim 4, wherein the second movement parameter setting unit sets a distance between a position of the second liquid jet head and the position of the first medium floating detection unit on the transport path of the medium to be transported by the medium transport unit, a transport speed of the medium transported by the medium transport unit, and a moving distance of the second liquid jet head, which is calculated using the floating distance of the medium detected by the first medium floating detection unit, as the second movement parameter.

6. The liquid jetting apparatus according to claim 1, wherein the medium transport unit comprises a transport drum that has a cylindrical shape and is rotated about a central axis of the cylindrical shape as a rotating axis to transport the medium along an outer peripheral surface thereof, and the second movement parameter setting unit sets the moving distance of the second liquid jet head that exceeds the moving distance of the first liquid jet head.

7. The liquid jetting apparatus according to claim 6, further comprising:

a third liquid jet head that is disposed at a position on a downstream side of the second liquid jet head in the medium transport direction and jets liquid onto the medium transported by the medium transport unit;

a third head raising/lowering unit that moves the third liquid jet head in the direction having the component corresponding to the direction opposite to the direction of gravity or in the direction having the component corresponding to the direction of gravity;

a third movement parameter setting unit that sets a third movement parameter including a moving distance of the third liquid jet head moved by the third head raising/lowering unit separately from the first movement parameter including the moving distance of the first liquid jet head set by the first movement parameter setting unit and the second movement parameter including the moving distance of the second liquid jet head set by the second movement parameter setting unit; and a third head raising/lowering control unit that controls an operation of the third head raising/lowering unit using the third movement parameter set by the third movement parameter setting unit, wherein the third movement parameter setting unit sets the moving distance of the third liquid jet head that exceeds the moving distance of the second liquid jet head.

8. The liquid jetting apparatus according to claim 6, wherein the transport drum comprises a grip part that includes a plurality of grip members gripping a front end region of the medium.

9. The liquid jetting apparatus according to claim 1, further comprising:

a second medium floating detection unit that is disposed at a position on a downstream side of the first liquid jet head in the medium transport direction and on an upstream side of the second liquid jet head in the medium transport direction and detects the floating of the medium transported by the medium transport unit and a floating distance of the medium transported by the medium transport unit, wherein the second movement parameter setting unit sets a distance between a position of the second liquid jet head and the position of the second medium floating detection unit on the transport path of the medium to be transported by the medium transport unit, a transport speed of the medium transported by the medium transport unit, and a moving distance of the second liquid jet head, which is calculated using the floating distance of the medium detected by the second medium floating detection unit, as the second movement parameter.

10. The liquid jetting apparatus according to claim 9, wherein the medium transport unit comprises a planar medium transport member that transports the medium on a plane parallel to the medium support surface.

11. A method of coping with floating of a medium for a liquid jetting apparatus that includes a first liquid jet head jetting liquid onto a sheet-like medium transported along a medium transport direction and a second liquid jet head disposed at a position on a downstream side of the first liquid jet head in the medium transport direction, the method comprising:

a medium floating detection step of detecting floating of the sheet-like medium that is supported by a medium support surface and transported along the medium transport direction;

a first movement parameter-setting step of setting a first movement parameter, which includes a moving distance of the first liquid jet head in a direction having a component corresponding to a direction opposite to a direction of gravity, in a case where the floating of the medium is detected in the medium floating detection step;

a second movement parameter-setting step of setting a second movement parameter that includes a moving distance of the second liquid jet head in the direction having the component corresponding to the direction opposite to the direction of gravity separately from the first movement parameter including the moving distance of the first liquid jet head in a case where the floating of the medium is detected in the medium floating detection step;

a first head moving step of moving the first liquid jet head from a first jet position where liquid is jetted from the first liquid jet head to a first retreat position, which is away from the first jet position in a moving direction of the first liquid jet head by the moving distance of the first liquid jet head, on the basis of the first movement parameter set in the first movement parameter-setting step in a case where the floating of the medium is detected in the medium floating detection step; and a second head moving step of moving the second liquid jet head from a second jet position where liquid is jetted from the second liquid jet head to a second retreat position, which is away from the second jet position in a moving direction of the second liquid jet head by the moving distance of the second liquid jet head, on the basis of the second movement parameter set in the second movement parameter-setting step in a case where the floating of the medium is detected in the medium floating detection step, wherein the moving distance of the first liquid jet head is different from the moving distance of the second liquid jet head.

* * * * *